US006147449A

United States Patent [19]

Iwasaki et al.

[11] Patent Number: 6,147,449

[45] **Date of Patent: *Nov. 14, 2000**

[54] ELECTRON-EMITTING DEVICE, WITH COATING FILM MADE OF HEAT-RESISTANT MATERIAL AND ELECTRON SOURCE AND IMAGE-FORMING APPARATUS USING THE DEVICE AND MANUFACTURE METHOD THEREOF

[75] Inventors: Tatsuya Iwasaki, Atsugi; Masato Yamanobe, Machida; Takeo Tsukamoto, Atsugi; Keisuke Yamamoto, Yamato; Yasuhiro Hamamoto, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/508,906

[22] Filed: Jul. 28, 1995

[30] Foreign Application Priority Data

| | | | |
|---|---|---|---|
| Aug. 2, 1994 | [JP] | Japan | 6-181286 |
| Aug. 2, 1994 | [JP] | Japan | 6-181287 |
| Jul. 21, 1995 | [JP] | Japan | 7-185451 |

[51] Int. Cl.[7] ..... M01J 1/05

[52] U.S. Cl. ..... 313/495; 313/310

[58] Field of Search ..... 313/495, 309, 313/336, 351, 310

[56] References Cited

U.S. PATENT DOCUMENTS 5,285,129 2/1994 Takeda et al. ..... 313/346

FOREIGN PATENT DOCUMENTS 0605881 7/1994 European Pat. Off. .
0660357 6/1995 European Pat. Off. .

OTHER PUBLICATIONS

"Scanning Tunnelling Microscopic Investigations of Electroformed Planar Metal–insulator–metal Diodes," H. Pagnia, N. Sotnik and W. Wirth, Int. J. Electronics, vol. 69, No. 1, 25–32 (1990).

"Energy Distribution of Emitted Electrons from Electroformed MIM Structures: The Carbon Island Model," M. Bischoff, H. Pagnia and J. Trickl, INt. J. Electronics, vol. 73, No. 5, 1009–1010 (1992).

"On the Electro Emission from Evaporated Thin Au Films," M. Bischoff, R. Holzer and H. Pagnia, Physics Letters, vol. 62A, No. 7 (Oct. 3, 1977).

"The Electroforming Process in MIM Diodes," vol. 85, R. Blessing, H. Pagnia and N. Sotnik, Thin Solid Films, 119–128 (1981).

(List continued on next page.)

*Primary Examiner*—Vip Patel
*Attorney, Agent, or Firm*—Fitzpatrick, Cella, Harper & Scinto

[57] ABSTRACT

In an electron-emitting device including, between electrodes, an electroconductive film having an electron emitting region, the electroconductive film has a film formed in the electron emitting region and made primarily of a material having a higher melting point than that of a material of the electroconductive film. Alternatively, the electroconductive film has a film formed in the electron emitting region and made primarily of a material having a higher temperature at which the material develops a vapor pressure of $1.3\times10^{-3}$ Pa, than that of a material of the electroconductive film. A manufacturing method for an electron-emitting device includes a step of forming a film made primarily of a metal in the electron emitting region of the electroconductive film. The electron-emitting device has stable characteristics and improved efficiency of electron emission. An image-forming apparatus comprising the electron-emitting devices has high luminance and excellent stability in operation.

35 Claims, 19 Drawing Sheets

OTHER PUBLICATIONS

"Evidence for the Contribution of an adsorbate to the Voltage–Controlled Negative Resistance of Gold Island Film Diodes," R. Blessing, H. Pagnia and R. Schmitt, Thin Solid Films, vol. 78, 397–401 (1981).

"Water–Influenced Switching in Discontinuous Au Film Diodes," R. Muller and H. Pagnia, Materials Letters, vol. 2, No. 4A, 283–285 (Mar. 1984).

"Influence of Organic Molecules on the Current–Voltage Characteristic of Planar MIM Diodes," H. Pagnia, N. Sotnick and H. Strauss, Phy. Stat. Sol., vol. 90, 771–778 (1985).

"Influence of Gas Composition on Regeneration in Metal/Insulator/Metal Diodes," M. Borbonus, H. Pagnia and N. Sotnik, Thin Solid Films, vol. 151, 333–342 (1987).

"Prospects for Metal/non–Metal Microsystems: Sensors, Sources and Switches," H. Pagnia, Int. J. Electronics, vol. 73, No. 5, 319–825 (1992).

"Carbon–nanoslit Model for The Electroforming Process in MIM Structures," M. Bischoff, Int. J. Electronics, vol. 70, No. 3, 491–498 (1991).

H. Pagnia et al., "Metal Influence on Switching MIM Diodes", phys. stat. sol. (a) 111,387 (1989).

Patent Abstracts of Japan, vol. 013, No. 476 (E–837), Oct. 16, 1989 & JP 01 186740 A (Canon Inc), Jul. 26, 1989.

M. Hartwell, et al., "Strong Electron Emission From Patterned Tin–Indium Oxide Thin Films," Int. Electron Devices Meeting, 1975, pp. 519–521.

M. Elinson, et al., "The Emission of Hot Electrons and The Field Emission of Electrons from Tin Oxide," Radio Engineering and Electronic Physics, 1965, pp. 1290–1296.

H. Araki, et al., "Electroforming and Electron Emission of Carbon Thin Flims," J. Vac. Soc. Japan, vol. 26, 1983, pp. 22–29.

G. Dittmer, "Electrical Conduction and Electron Emission of Discontinuous Thin Films," Thin Solid Films, 9 (1972) pp. 317–328.

C.A. Spindt, et al., "Physical Properties of Thin–Film Field Emission Cathodes with Molybdenum Cones," J. Appl. Phys., vol. 47, (1976), pp. 5248–5263.

Dyke and Dolan, "Field Emission," Advances in Electronics and Electron Physics, vol. VIII, (1956), pp. 90–185.

ELECTRON-EMITTING DEVICE, WITH COATING FILM MADE OF HEAT-RESISTANT MATERIAL AND ELECTRON SOURCE AND IMAGE-FORMING APPARATUS USING THE DEVICE AND MANUFACTURE METHOD THEREOF

BACKGROUND OF THE INVENTION

1. Field of the Invention

The present invention relates to an electron-emitting device, particularly an electron-emitting device which can maintain stable electron emission for a long time, an electron source using the electron-emitting devices, an image-forming apparatus, such as a display device and an exposure device, using the electron source, as well as manufacture methods for the electron-emitting device, the electron source, and the image-forming apparatus.

2. Related Background Art

There are hitherto known two major types of electron-emitting devices; i.e., thermionic cathode type electron-emitting devices and cold cathode type electron-emitting devices. Cold cathode type electron-emitting devices include the field emission type (hereinafter abbreviated to FE), the metal/insulating layer/metal type (hereinafter abbreviated to MIM), the surface conduction type, etc.

Examples of FE electron-emitting devices are described in, e.g., W. P. Dyke & W. W. Dolan, "Field emission", Advance in Electron Physics, 8, 89 (1956) and C. A. Spindt, "Physical properties of thin-film field emission cathodes with molybdenum cones", J. Appl. Phys., 47, 5248 (1976).

One example of MIM electron-emitting devices is described in, e.g., C. A. Mead, "Operation of Tunnel-Emission Devices", J. Appl. Phys., 32, 646 (1961).

One example of surface conduction electron-emitting devices is described in, e.g., M. I. Elinson, Radio Eng. Electron Phys., 10, 1290, (1965).

Surface conduction electron-emitting devices operate based on such a phenomenon that when a thin film of small area is formed on a base plate and a current is supplied to flow parallel to the film surface, electrons are emitted therefrom. As to such surface conduction electron-emitting devices, there have been reported, for example, one using a thin film of $SnO_2$ by Elinson cited above, one using an Au thin film [G. Dittmer: Thin Solid Films, 9, 317 (1972)], one using a thin film of $In_2O_3/SnO_2$ [M. Hartwell and C. G. Fonstad: "IEEE Trans. ED Conf.", 519 (1975)], and one using a carbon thin film [Hisashi Araki et al.: Vacuum, Vol. 26, No. 1, 22 (1983)].

As a typical example of those surface conduction electron-emitting devices, FIG. 20 schematically shows the device configuration proposed by M. Hartwell; et al. in the above-cited paper. In FIG. 20, denoted by reference numeral 1 is a substrate (hereinafter, it is refered as "a base plate"). 4 is an electroconductive thin film formed of, e.g., a metal oxide thin film made by sputtering into an H-shaped pattern, in which an electron-emitting region 5 is formed by energization treatment called energization forming (described later). Incidentally, the spacing L between opposed device electrodes is set to 0.5–1 mm and the width W of the electroconductive thin film is set to 0.1 mm.

In those surface conduction electron-emitting devices, it has heretofore been customary that, before starting the emission of electrons, the electron-emitting region 5 is previously formed by energization treatment called energization forming. Specifically, the term "energization forming" means treatment of applying a DC voltage or a voltage gradually increasing at a very slow rate of about 1 V/minute, for example, across the electroconductive thin film 4 to locally destroy, deform or denature it to thereby form the electron-emitting region 5 which has been transformed into an electrically high-resistant state. In the electron-emitting region 5, an electron emitting region is produced in part of the electroconductive thin film 4 and electrons are emitted from the vicinity of the fissure.

Since the above surface conduction electron-emitting devices are simpler in structure and can relatively easily be formed in a large number at a high density, their application to image-forming apparatus or the like is expected. If stable electron emission is continued for a long time and characteristics and efficiency of electron emission are improved, it will be possible in image-forming apparatus using a fluorescent film as an image-forming member, by way of example, to realize low-current, bright and high-quality apparatus, e.g., flat TV units. Also, with a lowering in current required, the cost of a driving circuit and so on making up the image-forming apparatus can be cut down.

However, the aforementioned electron-emitting device proposed by M. Hartwell et al. is not sufficiently satisfactory in points of stable electron emission characteristics and efficiency. Thus, it is very difficult in the state of art to provide image-forming apparatus, which has high luminance and excellent stability in operation, by using such electron-emitting devices.

SUMMARY OF THE INVENTION

In view of the above-mentioned technical problems to be solved, an object of the present invention is to provide an electron-emitting device which has stable characteristics of electron emission and also has improved efficiency of electron emission. Another object of the present invention is to provide an image-forming apparatus which has high luminance and excellent stability in operation.

To achieve the above objects, the present invention includes by the following aspects.

According to an aspect of the present invention, there is provided an electron-emitting device including, between electrodes, an electroconductive film having an electron emitting region, wherein the electroconductive film has a film formed in the electron emitting region and made primarily of a material having a higher melting point than that of a material of the electroconductive film.

According to another aspect of the present invention, there is provided an electron-emitting device including, between electrodes, an electroconductive film having an electron emitting region, wherein the electroconductive film has a film formed in the electron emitting region and made primarily of a material having a higher temperature, at which the material develops a vapor pressure of $1.3\times10^{-3}$ Pa, than that of a material of the electroconductive film.

According to still another aspect of the present invention, there is provided a manufacture method of an electron-emitting device including, between electrodes, an electroconductive film having an electron emitting region, wherein the method includes a step of forming a film made primarily of a metal in the electron emitting region of the electroconductive film.

According to still further aspects of the present invention, there are provided an electron source comprising the electron-emitting devices arrayed in large number on a base plate, an image-forming apparatus comprising such an electron source and an image-forming member, and manufacture methods of the electron source and the image-forming apparatus.

DESCRIPTION OF THE PREFERRED EMBODIMENTS

One reason why sufficiently stable characteristics of electron emission are not achieved in the prior art surface conduction electron-emitting devices as mentioned above is presumably a change in the microstructural shape of the electron-emitting region caused by that, due to heat generated by the current flowing through the electron-emitting region, the material making up ends of the electroconductive thin film facing the fissure is lost by sublimation, or the electroconductive thin film is locally melted and deformed.

To solve that problem, in the present invention, a coating film of which material is primarily made of a metal and different from the material of the electroconductive thin film in the electron-emitting region is formed in the electron-emitting region comprising the fissure formed in the electroconductive thin film. To prevent the electroconductive thin film in the electron-emitting region from being deformed by local melting or consumed by sublimation, the metal material of the coating film is required to have the higher melting point than that of the material of the electroconductive thin film in the electron-emitting region, or to have a higher temperature, at which it develops a vapor pressure equal to the pressure of a vacuum atmosphere where the device is actually driven, generally at which it develops a vapor pressure of about $1.3\times10^{-3}$ Pa (nearly $10^{-5}$ Torr), than that of the material of the electroconductive thin film. Even when any of the conditions is not satisfied in a metal state, a similar advantage is also expected, by way of example, if an oxide layer is formed on the surface and the oxide meets any of the conditions. The applicants have found that electron-emitting regions of surface conduction electron-emitting devices tend to be consumed at a higher rate on the high potential side than on the low potential side. Therefore, it is required for the coating film to cover at least an end of the electroconductive thin film positioned on the high potential side and facing the fissure of the electron-emitting region, preferably to cover an end of the electroconductive thin film on the high potential side as well. Additionally, the present invention also includes such a structure that the coating film covers an area of the electroconductive thin film extending from its end facing the fissure toward a device electrode, but near the fissure.

Figure 1A:
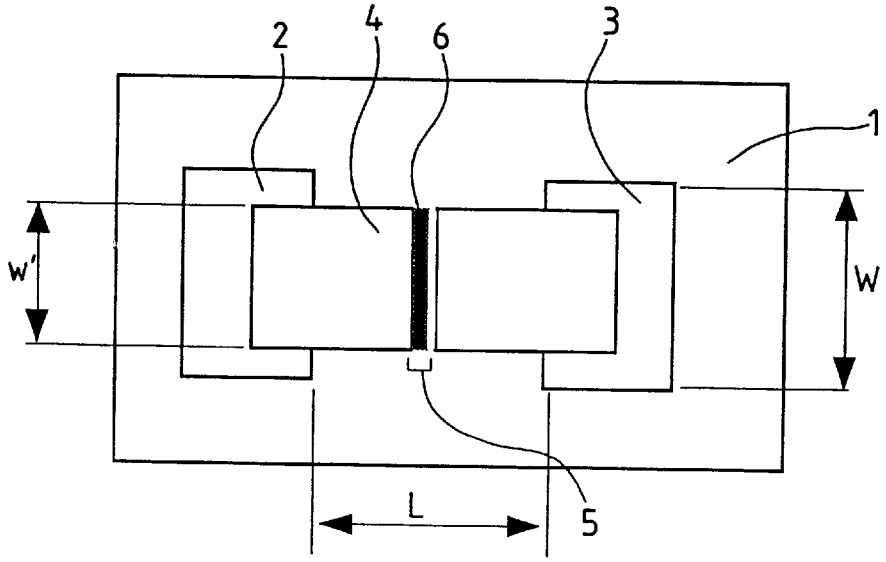
FIGS. 1A and 1B are schematic views showing one exemplary structure of an electron-emitting device of the present invention.
Figure 1B:
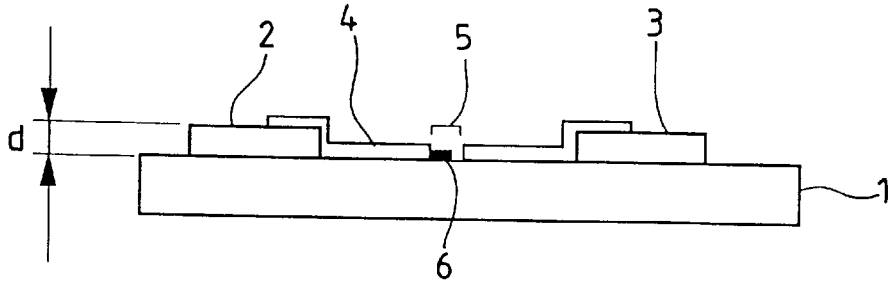

FIGS. 1A and 1B are a schematic plan and sectional view, respectively, showing one exemplary structure of a plane type surface conduction electron-emitting device of the present invention.

In FIGS. 1A and 1B, denoted by 1 is a base plate, 2 and 3 are device electrodes, 4 is an electroconductive thin film, 5 is an electron-emitting region, and 6 is the aforementioned coating film made of a material having the higher melting point.

The base plate 1 may be made of any of various glasses such as quartz glass, glass containing an impurity such as Na in reduced content, soda lime glass, and glass having $SiO_2$ laminated on soda lime glass by, e.g., sputtering, or ceramics such as alumina.

The device electrodes 2, 3 opposed to each other can be made of any of usual conductive materials. By way of example, a material for the device electrodes may be selected from metals such as Ni, Cr, Au, Mo, W, Pt, Ti, Al, Cu and Pd or alloys thereof, printing conductors comprising metals such as Pd, Ag, Au, $RuO_2$ and Pd-Ag or oxides thereof, glass and so on, transparent conductors such as $In_2O_3$—$SnO_2$, and semiconductors such as polysilicon.

The spacing L between the device electrodes, the length W of each device electrode, the shape of the electroconductive thin film 4, etc. are designed in view of the form of application and other conditions. The spacing L between the device electrodes is preferably in the range of several tens nm to several hundreds μm, more preferably in the range of several μm to several tens μm, taking into account the voltage applied to between the device electrodes, the electrical intensity capable of emitting electrons, and so on.

In consideration of a resistance value between the device electrodes and characteristics of electron emission, the length W of each device electrode can be set in the range of several μm to several hundreds μm, The film thickness d of the device electrodes 2, 3 can set in the range of several tens nm to several μm.

In addition to the structure shown in FIGS. 1A and 1B, the surface conduction electron-emitting device may also be structured by laminating the electroconductive thin film 4 and the device electrodes 2, 3 opposed to each other on the base plate 1 successively.

In order to provide good characteristics of electron emission, it is preferable that the electroconductive thin film 4 be formed of a fine particle film made up by fine particles. The thickness of the electroconductive thin film 4 is appropriately set in consideration of step coverage to the device electrodes 2, 3, a resistance value between the device electrodes 2, 3, conditions of Forming treatment (described later), and so on. In general, the film thickness is preferably in the range of several 0.1 nm to several hundreds nm, more preferably in the range of 1 nm to 50 nm. Also, the electroconductive thin film 4 has a resistance value $R_s$ in the range of $10^2$ to $10^7$ Ω/□. Note that $R_s$ is determined based on $R=R_s(l/w)$ where R is resistance of a thin film having a thickness of t, a width of w and a length of 1. While Forming treatment will-be described in this specification with regard to, by way of example, energization treatment, manners of carrying out the Forming treatment are not limited to energization, and include other suitable physical or chemical processes capable of causing a fissure in the film and establishing a high-resistance state.

Practical examples of a material used to form the electroconductive thin film 4 include metals such as Pd, Pt, Ru, Ag, Au, Ti, In, Cu, Cr, Fe, Zn, Sn and Pb, oxides such as PdO, $SnO_2$, $In_2O_3$, PbO and $Sb_2O_3$, borides such as $LaB_6$, $CeB_6$, $YB_4$ and $GdB_4$, carbides such as TiC and SiC, nitrides such as TiN, and semiconductors such as Si and Ge.

As there often appears the term "fine particle" in this specification, the meaning of this term will be explained.

A small particle is called a "fine particle" and a particle smaller than the fine particle is called a "ultra fine particle". It is also customary that a particle smaller than the ultra fine particle and consisted of atoms in number hundred or less is called a "cluster".

However, the boundary between particle sizes represented by the respective terms is not strict, but varied depending on which property is taken into consideration when classifying small particles. "Fine particle" and "ultra fine particle" are both often called "fine particle" together, and this specification employs this rule.

"Experimental Physics Lecture 14 Surface.Fine Particle", (compiled by Koreo Kinoshita, Kyoritsu Publishing, published Sep. 1, 1986) reads as follows.

"It is assumed that, when the term "fine particle" is used in this Lecture, it means particles having a diameter roughly ranging from 2–3 μm to 10 nm, and the term "ultra fine particle" is especially used, it means particles having a particle size roughly ranging from 10 nm to 2–3 nm. Both the particles are often simply expressed as "fine particle" together, and the above-mentioned ranges are never strictly delimited, but should be understood as a guideline. When the number of atoms making up a particle is on the order of from 2 to several tens to several hundreds, the particle is called a cluster." (page 195, pp. 22–26)

Additionally, based on definition of "ultra fine particle" made by "Hayashi.Ultra Fine Particle Project" in New Technology Development Operation Group of Japan, a lower limit of the particle size is lower than above as follows.

"In "Ultra Fine Particle Project" (1981–1986) according to Creative Science & Technology Promotion System, we decided to call a particle having a particle size (diameter) in the range of about 1 to 100 nm as "ultra fine particle". Based on this definition, one ultra fine particle is an aggregate of atoms in number roughly 100 to $10^8$. Looking from the atomic scale, the ultra fine particle is a large or extra large particle." ("Ultra Fine Particle—Creative Science & Technology—", compiled by Chikara Hayashi, Ryoji Ueda, and Akira Tasaki; Mita Publishing 1988, page 2, pp. 1 to 4); and "A particle smaller than the ultra fine particle, that is to say, one particle consisted of atoms in number several to several hundreds is usually called a cluster.", (Ibid., page 2, pp. 12 to 13).

In view of the above phraseology generally employed, the term "fine particle" used in this specification is assumed to mean an aggregate of numerous atoms and/or molecules having a particle size of which lower limit is roughly from several tenths of a nm to 1 nm, and the upper limit is roughly about several μm.

The electron-emitting region 5 is constituted by a high-resistance fissure developed in part of the electroconductive thin film 4, and is formed depending on the thickness, properties and material of the electroconductive thin film 4, the manner of the energization forming (described later), and so on. The electron-emitting region 5 may be made up by electroconductive fine particles having a particle size in the range of several tenths of a nm to several tens of nm. The electroconductive fine particles contain part or all of elements making up a material of the electroconductive thin film 4. The electron-emitting region 5 includes the coating film 6 made of a material having the higher melting point.

A step type surface conduction electron-emitting device will now be described.

Figure 2:
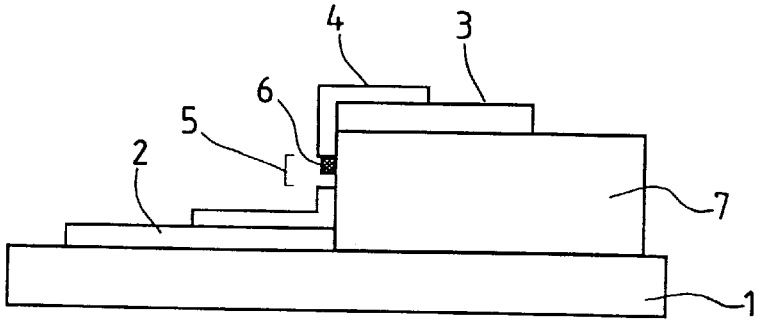
FIG. 2 is a schematic view showing another exemplary structure of an electron-emitting device of the present invention.

FIG. 2 is a schematic view showing one exemplary structure of a plane type surface conduction electron-emitting device which can also be used as the surface conduction electron-emitting device of the present invention.

In FIG. 2, the same components as those in FIGS. 1A and 1B are denoted by the same reference numerals as those in FIGS. 1A and 1B. Denoted by 7 is a step-forming section. A base plate 1, device electrodes 2 and 3, an electroconductive thin film 4, and an electron-emitting region 5 can be made of similar materials as used in the plane type surface conduction electron-emitting device explained above. The step-forming section 7 is formed of, e.g., an electrically insulating material such as $SiO_2$ by vacuum vapor deposition, printing, sputtering or the like. The film thickness of the step-forming section 7 corresponds to the spacing L between the device electrodes in the plane type surface conduction electron-emitting device explained above and, hence, it can range from-several tens tenths of a nm to several tens of μm. While the film thickness of the step-forming section 7 is set in consideration of the manufacture process of the step-forming section, the voltage applied to between the device electrodes, the electrical intensity capable of emitting electrons, and so on, it is preferably in the range of several tens of nm to several μm.

The electroconductive thin film 4 is laminated on the device electrodes 2, 3 after the device electrodes 5, 6 and the step-forming section 7 have been formed. Although the electron-emitting region 5 is formed linearly in the step-forming section 7 in FIG. 2, the shape and position of the electron-emitting region 5 depend on the manufacture conditions, the forming conditions, etc., and are not limited to illustrated ones.

While the surface conduction electron-emitting devices explained above can be manufactured by various methods, one example of the manufacture methods is illustrated in FIGS. 3A to 3D.

One manufacture method will be described below following successive steps with reference to FIGS. 1A and 1B and FIGS. 3A to 3D. In FIGS. 3A to 3D, the same components as those in FIGS. 1A and 1B are denoted by the same reference numerals as those in FIGS. 1A and 1B.

Figure 3A:
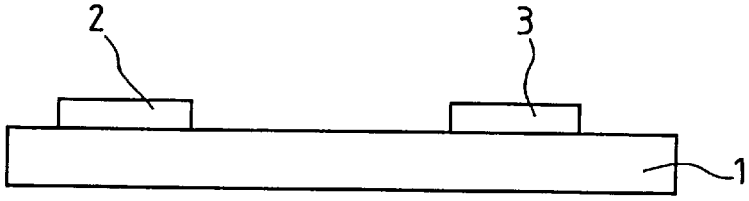
FIGS. 3A to 3D are schematic views for explaining a manufacture process according to the present invention.

1) The base plate 1 is sufficiently washed with a detergent, pure water and an organic solvent. A device electrode material is then deposited on the base plate by vacuum vapor deposition, sputtering or the like. After that, the deposited material is patterned by photolithography, for example, to form the device electrodes 2, 3 on the base plate 1 (FIG. 3A).

Figure 3B:
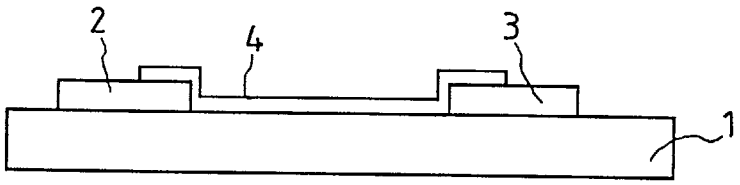

2) Over the base plate 1 including the device electrodes 2, 3 formed thereon, an organic metal solution is coated to form an organic metal thin film. As the organic metal solution, a solution of an organic metal compound containing, as a primary element, a material metal of the electroconductive thin film 4. The organic metal thin film is heated for calcination and then patterned by lift-off, etching or the like to form the electroconductive thin film 4 (FIG. 3B). While the organic metal solution is coated on the base plate 1, the electroconductive thin film 4 may be formed by not only simple coating, but also vacuum vapor deposition, sputtering, chemical vapor deposition, dispersion coating, dipping, spinner coating, etc.

Figure 3C:
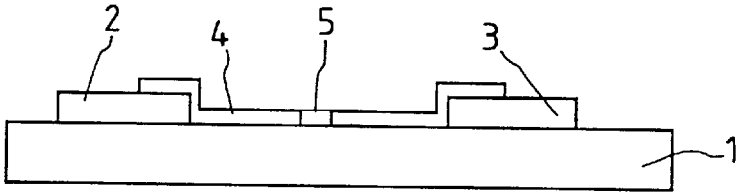
Figure 3D:
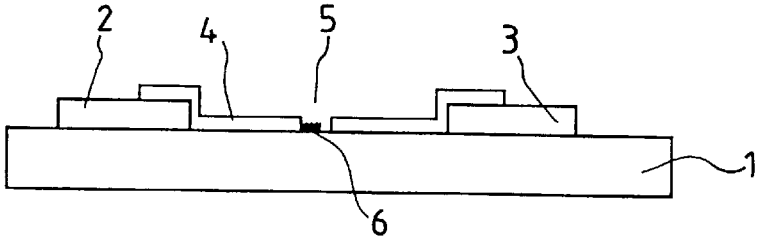

3) Subsequently, energization treatment called forming is performed. When a voltage is applied to between the device electrodes 2, 3 from a power supply (not shown) to form, the electron-emitting region 5 is formed in part of the electroconductive thin film 4 (FIG. 3C). Examples of voltage waveform applied for the energization forming are shown in FIGS. 4A and 4B.

The voltage waveform is preferably of a pulse-like waveform. The energization forming can be performed by applying voltage pulses having a constant crest value successively (FIG. 4A), or by applying voltage pulses having crest values gradually increased (FIG. 4B).

Figure 4A:
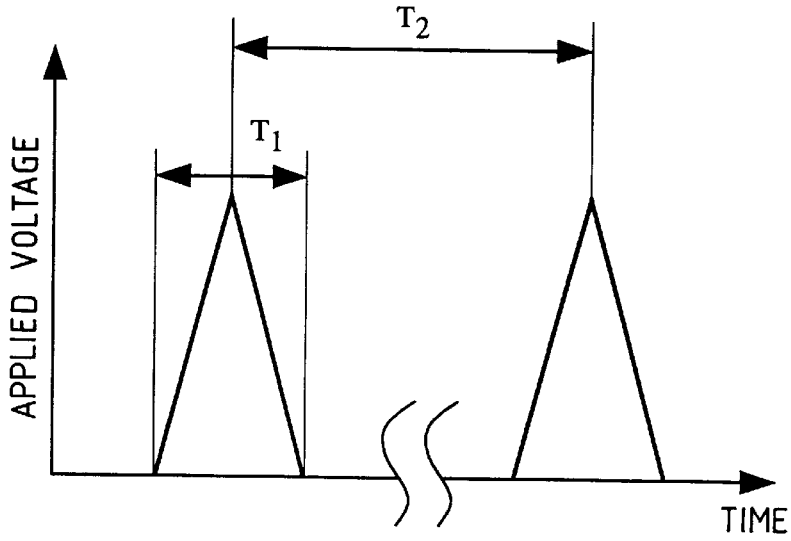
FIGS. 4A and 4B are charts showing waveforms of triangular pulses used in the manufacture process according to the present invention.

In FIG. 4A, T1 and T2 represent respectively a pulse width and a pulse interval of the voltage waveform. Usually, T1 is set to fall in the range of 1 μsec. to 10 msec. and T2 is set to fall in the range of 10 μsec. to 100 msec. A crest value of the triangular waveform (i.e., a peak voltage during the energization Forming) is appropriately selected depending on the type of surface conduction electron-emitting device. Under these conditions, the voltage is applied for a period of several seconds to several tens minutes at a proper degree of vacuum. The pulse waveform is not limited to triangular one, but may have any other desired waveform such as rectangular one.

Figure 4B:
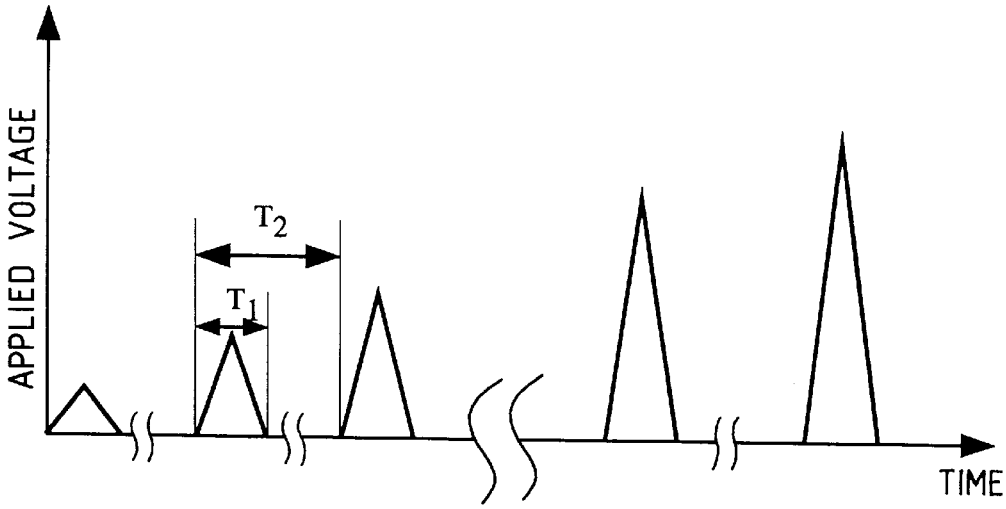

In the method shown in FIG. 4B, T1 and T2 can be set to similar values as in the method shown in FIG. 4A. A crest value of the triangular waveform (i.e., a peak voltage during the energization Forming) is gradually increased, for example, at a rate of 0.1 V per pulse.

The time at which the energization forming is to be finished can be detected by applying a voltage whose value is so selected as not to locally destroy or deform the electroconductive thin film 4 and measuring a device current during the pulse interval T2. By way of example, a voltage of about 0.1 V is applied and a resulting device current is measured to determine a resistance value. When the resistance value exceeds 1 MΩ, the energization forming is finished.

4) Then, the coating film made of a material having the higher melting point is formed. The material of the coating film is preferably a simple metal or alloy of elements belonging to Groups IVa, Va, VIa, VIIa and VIIIa in the fifth and sixth periods, or a mixture thereof because of having the high melting point. More specifically, Nb, Mo, Ru, Hf, Ta, W, Re, Os and Ir have the melting point not lower than 2000° C. in the form of a simple metal and, therefore, are preferably used as the material. Zr and Rh are also usable because of having the melting point near 2000° C. The temperature at which the material develops a vapor pressure of $1.3\times10^{-3}$ Pa ($10^{-5}$ Torr) is 1370 K for Pd that is used, by way of example, to form the electroconductive thin film, whereas that temperature is 2840 k for W, 2680 K for Ta, 2650 K for Re, 2600 K for Os, 2390 K for Nb, and so on. Thus, any of those elements can preferably be employed. In particular, W is a preferable material because it has the highest melting point of 3380° C. among those metals. Also, Ni belonging to the fourth period has the melting point of 1453° C. as a simple metal lower than 1554° C. of Pd, but an alloy of Ni formed by adding W of about 10 atomic % has the melting point raised to 1500° C. or more. Further, when an oxide layer is formed on the alloy surface, the melting point rises to near 2000° C. and the rate of evaporation due to the electric field is extremely reduced. Therefore, Ni is also expected to exhibit an effect of preventing wear of the electron-emitting region.

Since the coating film is formed only near the electron-emitting region, it is simple to use any thin film deposition process by which the coating film is deposited by applying a voltage to between the device electrodes. More specifically, there can be used a process of applying a voltage to between the device electrodes and forming a plated film by electrolyte plating, or chemical vapor growth by which a voltage is applied to between the device electrodes in an atmosphere containing a compound of a metal to be coated and the compound is decomposed to deposit a film of the metal.

Plating baths used in the plating process include, for example, a citric acid—ammonia bath containing $Na_2WO_4$ and $NiSO_4$, and a nickel sulfosalicylate bath for forming a Ni thin film. Metal compounds used to create the atmosphere in the chemical vapor growth include, for example, metal halides such as fluorides, chlorides, borides and iodides, metal alkylates such as methylates, ethylates and benzylates, metal β-diketonates such as acetylacetonates, dipivaloylmethanates and hexafluoroacetylacetonate, metal enyl complexes such as allyl complexes and cyclopentadienyl complexes, arene complexes such as benzene complexes, metal carbonyls, metal alkoxides, and compounds combined with any of the above. From the necessity of depositing the above-mentioned material having the higher melting point, examples of preferred compounds used in the present invention include $NbF_5$, $NbCl_5$, $Nb(C_5H_5)(CO)_4$, $Nb(C_5H_5)_2Cl_2$, $OsF_4$, $Os(C_3H_7O_2)_3$, $Os(CO)_5$, $Os_3(CO)_{12}$, $Os(C_5H_5)_2$, $ReF_5$, $ReCl_5$, $Re(CO)_{10}$, $ReCl(CO)_5$, $Re(CH_3)(CO)_5$, $Re(C_5H_5)(CO)_3$, $Ta(C_5H_5)(CO)_4$, $Ta(OC_2H_5)_5$, $Ta(C_5H_5)_2Cl_2$, $Ta(C_5H_5)_2H_3$, $WF_6$, $W(CO)_6$, $W(C_5H_5)_2Cl_2$, $W(C_5H_5)_2H_2$, $W(CH_3)_6$, etc. Depending on the conditions, other substance such as carbon than the metal to be coated may be contained in the coating film.

In this treatment, crystallinity of the coating film may also be controlled by introducing a substance having etching ability, such as hydrogen, together with the metal compound. It is also possible to control the shape and others of the coating film by, e.g., heating the device. Such control is appropriately performed depending on the conditions.

As the coating film is formed with progress of the treatment, the current flowing between the device electrodes is increased. Accordingly, the time at which the treatment is to be finished is determined by measuring a current value. The conditions for determining whether the treatment is to be finished or not are appropriately decided in consideration of the treatment manner, the shape of the device, and so on.

After completion of the treatment, the device is cleaned. More specifically, in the case of employing the plating process, the device is washed with water or the like and then dried. In the case of employing the chemical vapor growth, the metal compound is evacuated from a vacuum treatment apparatus to create a clean vacuum atmosphere while heating the device and/or the vacuum treatment apparatus to a proper temperature, if necessary, and the device is left to stand in the clean vacuum atmosphere for a certain period of time.

The coating film formed by the above treatment may be such that fine particles are densely arrayed to form the film. In this state, the fine particles have a size roughly in the range of 30 to 100 nm although the particle size is varied depending on the voltage applied during the treatment and/or locations on one device.

Basic characteristics of the electron-emitting device of the present invention manufactured through the above-explained steps will be described below with reference to FIGS. 5 and 6.

Figure 5:
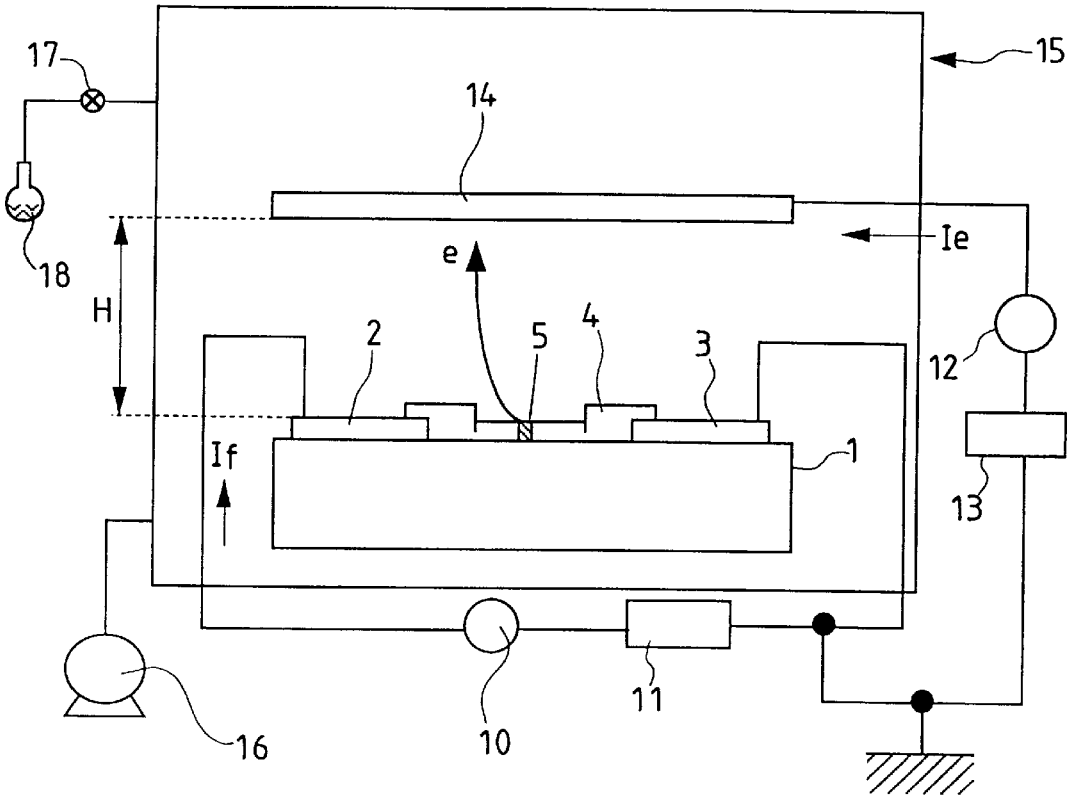
FIG. 5 is a diagram schematically showing a vacuum treatment apparatus used in the manufacture process according to the present invention and for evaluation of characteristics.

FIG. 5 is a schematic view showing one example of the vacuum treatment apparatus which doubles as a measuring/-evaluating apparatus. In FIG. 5, the same reference numerals as those in FIGS. 1A and 1B denote identical parts to those in FIGS. 1A and 1B. Referring to FIG. 5, denoted by 15 is a vacuum vessel and 16 is an evacuation pump. An electron-emitting device is placed in the vacuum vessel 15. The electron-emitting device comprises a base plate 1 on which the electron-emitting device is constructed, device electrodes 2 and 3, an electroconductive thin film 4, and an electron-emitting region 5. Though not shown, the coating film made of a material having the higher melting point is coated inside and near the fissure. Further, 11 is a power supply for applying a device voltage Vf to the electron-emitting device, 10 is an ammeter for measuring a device current If flowing through the electroconductive thin film 4 between the device electrodes 2 and 3, and 14 is an anode electrode for capturing an emission current Ie emitted from the electron-emitting region 5 of the device. Additionally, 13 is a high-voltage power supply for applying a voltage to the anode electrode 14, and 12 is an ammeter for measuring the emission current Ie emitted from the electron-emitting region 5 of the device. The measurement is performed, for example, by setting the voltage applied to the anode electrode in the range of 1 kV to 10 kV, and the distance H between the anode electrode and the electron-emitting device in the range of 2 mm to 8 mm.

The vacuum vessel 15 is provided with additional units (not shown) such as a vacuum gauge necessary to create a vacuum atmosphere for measurement, so that the device is measured and evaluated under a desired vacuum atmosphere. The evacuation pump 16 includes a normal high vacuum apparatus system comprising a turbo pump and a rotary pump, and a ultra-high vacuum apparatus system comprising an ion pump or the like. The whole of the vacuum treatment apparatus in which the electron-emitting is placed can be heated to 250° C. by a heater (not shown). Accordingly, the vacuum treatment apparatus can be used to perform the steps subsequent to the foregoing energization forming. Denoted by 18 is a material source in the form of an ampule or a bomb for storing the material to be introduced to the vacuum treatment apparatus, as required. 17 is a valve for adjusting the amount of the material introduced to the apparatus.

Figure 6:
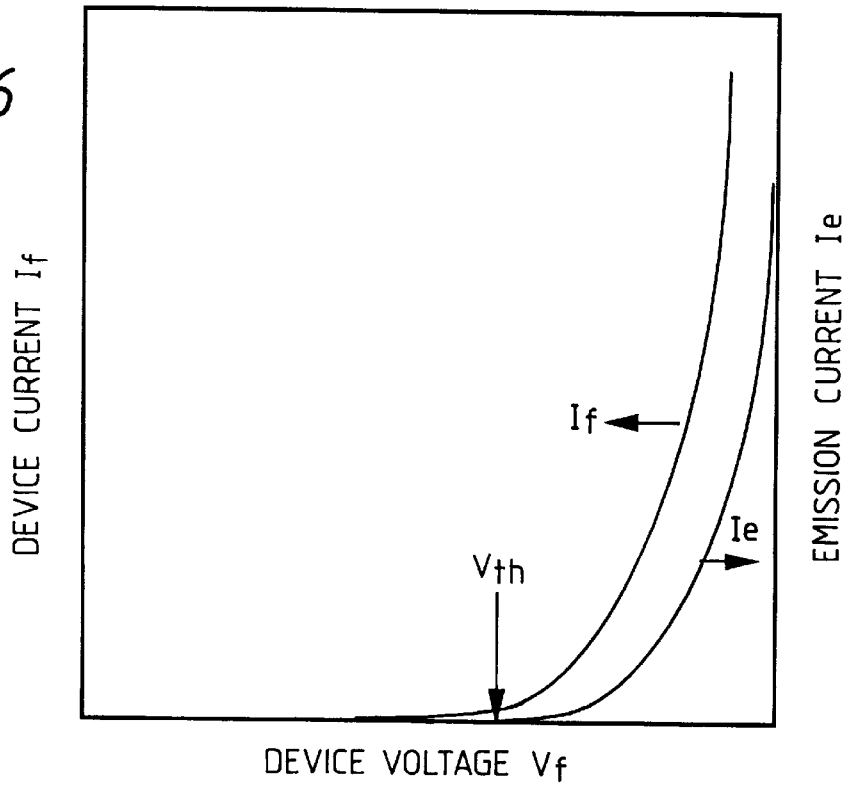
FIG. 6 is a graph showing electron emission characteristics of the electron-emitting device of the present invention.

FIG. 6 is a graph plotting the relationship between the emission current Ie and the device current If and the device voltage Vf measured by the vacuum treatment apparatus shown in FIG. 5. Note that the graph of FIG. 6 is plotted in arbitrary units because the emission current Ie is much smaller than the device current If. The vertical and horizontal axes each represent a linear scale.

As will be apparent from FIG. 6, the surface conduction electron-emitting device of the present invention has three characteristic features with regard to the emission current Ie as follows.

(i) In the electron-emitting device, the emission current Ie is abruptly increased when the device voltage greater than a certain value (called a threshold voltage, Vth in FIG. 6) is applied, but it is not appreciably detected below the threshold voltage Vth. Thus, the present device is a non-linear device having the definite threshold voltage Vth for the emission current Ie.

(ii) The emission current Ie increases monotonously depending on the device voltage Vf and, therefore, the emission current Ie can be controlled by the device voltage Vf.

(iii) Emitted charges captured by the anode electrode 14 depend on the time during which the device voltage Vf is applied. Thus, the amount of charges captured by the anode electrode 14 can be controlled with the time during which the device voltage Vf is applied.

As will be understood from the above explanation, electron emission characteristics of the surface conduction electron-emitting device of the present invention can easily be controlled in response to an input signal. By utilizing this feature, applications to a variety of fields, including an electron source, an image-forming apparatus, etc. using an array of the numerous electron-emitting devices are realized.

Further, in FIG. 6, the device current If increases monotonously with respect to the device voltage Vf (called MI characteristic hereinafter). The device current If may exhibit a voltage controlled negative resistance characteristic (called VCNR characteristic hereinafter) (not shown) with respect to the device voltage Vf. These characteristics of the device current are controllable depending on the manufacture conditions.

Application examples of the electron-emitting device which can be achieved in accordance with the present invention will be described below. An electron source or an image-forming apparatus, for example, can be made up by arraying a number of surface conduction electron-emitting devices of the present invention on a base plate.

The electron-emitting devices can be arrayed on a base plate by several methods.

By one method, a number of electron-emitting devices are arrayed side by side (in a row direction) and interconnected at both ends thereof in parallel by wires to form a row of electron-emitting devices, this row of electron-emitting devices being arranged in a large number. Control electrodes (called also grids) are disposed above the electron-emitting devices to lie in a direction (called a column direction) perpendicular to the row-directional wires for controlling emission of electrons from the electron-emitting devices. This is an electron source of ladder wiring type. By another method, a number of electron-emitting devices are arrayed in a matrix to lie in the X-direction and the Y-direction. Ones of the opposed electrodes of the plural electron-emitting devices lying in the same row are connected in common to one X-directional wire, and the others of the opposed electrodes of the plural electron-emitting devices lying in the same column are connected in common to one Y-directional wire. This is an electron source of simple matrix wiring type. A description will first be made of the simple matrix wiring type in detail.

The surface conduction electron-emitting devices to which the present invention is applicable have the above-mentioned characteristics from (i) to (iii). In other words, electrons emitted from each of the surface conduction electron-emitting devices are controlled depending on the crest value and width of a pulse-like voltage applied to between the device electrodes opposed to each other when the applied voltage is higher than the threshold value. On the other hand, almost no electrons are emitted at the voltage lower than the threshold value. Based on these characteristics, even when the surface conduction electron-emitting devices are arrayed in large number, it is possible to select any desired one of the electron-emitting devices and to control the amount of electrons emitted therefrom in response to an input signal by properly applying the pulse-like voltage to each corresponding device.

Figure 7:
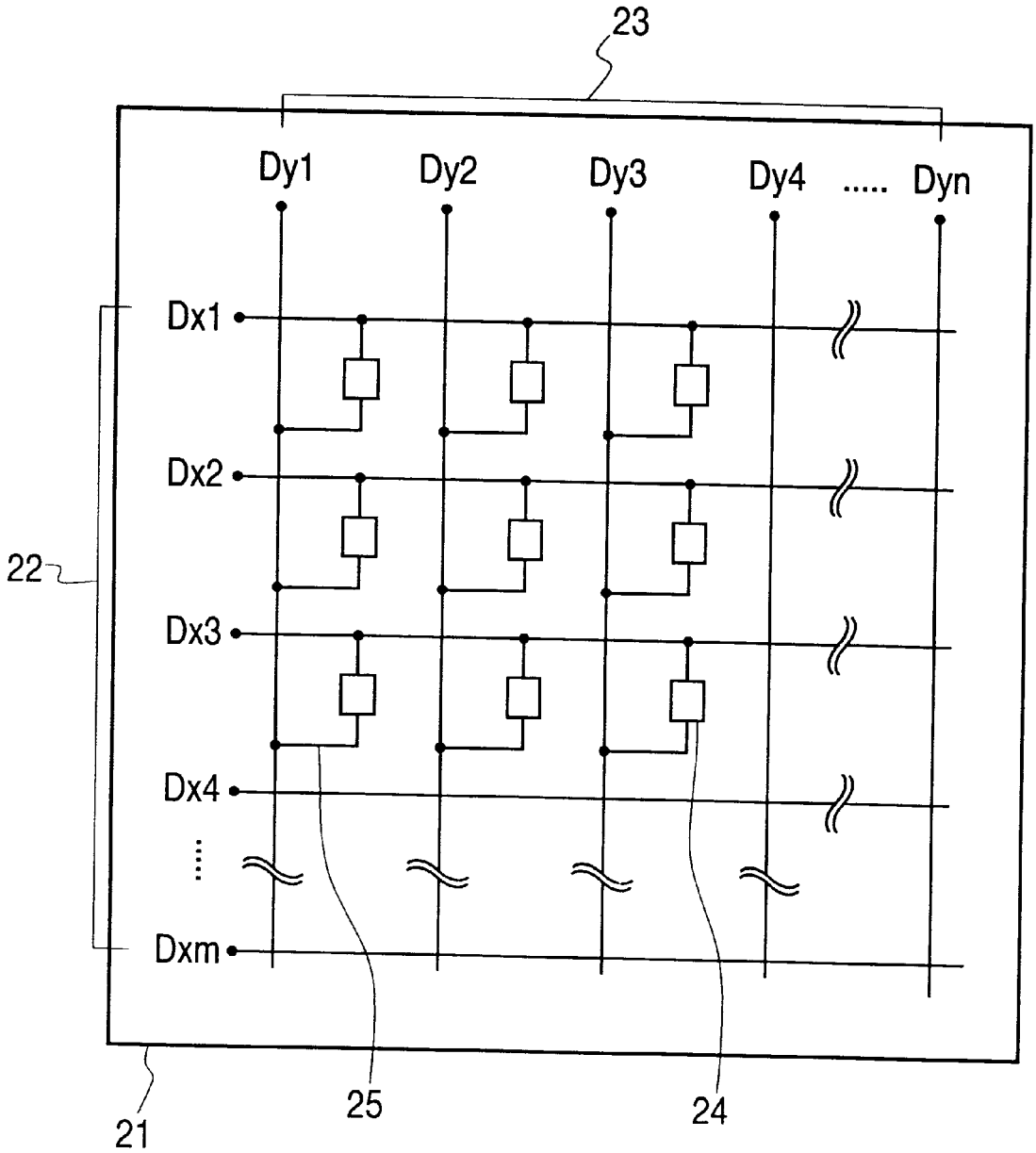
FIG. 7 is a diagram for explaining matrix wiring of an electron source of the present invention.

An electron source base plate constructed in accordance with the above principle by arranging a number of electron-emitting devices of the present invention will be described below with reference to FIG. 7. In FIG. 7, denoted by 21 is an electron source base plate, 22 is an X-directional wire, 23 is a Y-directional wire, 24 is a surface conduction electron-emitting device, and 25 a connecting wire. The surface conduction electron-emitting device 24 may be of either the plane or step type.

Then, m lines of X-directional wires 22, indicated by Dx1, Dx2, . . . , Dxm, are formed using an electroconductive metal or the like by vacuum vapor deposition, printing, sputtering or the like. The material, film thickness and width of the wires are appropriately designed case by case. Also, the Y-directional wires 23 are made up of n lines of Dy1, Dy2, . . . , Dyn and are formed in a like manner to the X-directional wires 22. An interlayer insulating layer (not shown) is interposed between the m lines of X-directional wires 22 and the n lines of Y-directional wires 23 to electrically isolate the wires 22, 23 from each other. (Note that m, n are each a positive integer.)

The not-shown interlayer insulating layer is made of $SiO_2$ or the like which is formed by vacuum vapor deposition, printing, sputtering or the like. By way of example, the interlayer insulating layer is formed in a desired shape so as to cover the entire or partial surface of the base plate 21 on which the X-directional wires 22 have been formed. The thickness, material and fabrication process of the interlayer insulating layer is appropriately set so as to endure the potential difference, particularly, in portions where the X-directional wires 22 and the Y-directional wires 23 intersect each other. The X-directional wires 22 and the Y-directional wires 23 are led out of the base plate to provide external terminals.

Respective paired electrodes (not shown) of the surface conduction electron-emitting devices 24 are electrically connected to the m lines of X-directional wires 22 and the n lines of Y-directional wires 23 as shown by the connecting wires 25 which are formed using an electroconductive metal or the like by vacuum vapor deposition, printing, sputtering or the like.

The material of the wires 22 and 23, the material of the connecting wires 25, and the material of the paired device electrodes may be the same in part or all of the constituent elements thereof, or may be different from one another. Those materials are appropriately selected, for example, from the materials explained above in connection with the device electrodes. Note that when the device electrodes and the wires are made of the same material, the term "device electrodes" may be used to mean both the device electrodes and the wirings connected thereto together.

The X-directional wires 22 are electrically connected to a scan signal generating means (not shown) for applying a scan signal to select each row of the surface conduction electron-emitting devices 24, which are arrayed in the X-direction, in response to an input signal. On the other hand, the Y-directional wires 23 are electrically connected to a modulation signal generating means (not shown) for applying a modulation signal to modulate each column of the surface conduction electron-emitting devices 24, which are arrayed in the Y-direction, in response to an input signal. A driving voltage applied to each of the surface conduction electron-emitting devices is supplied as a differential voltage between the scan signal and the modulation signal both applied to that device.

With the above arrangements, the individual devices can be selected and driven independently of one another by utilizing the simple matrix wiring.

Figure 8:
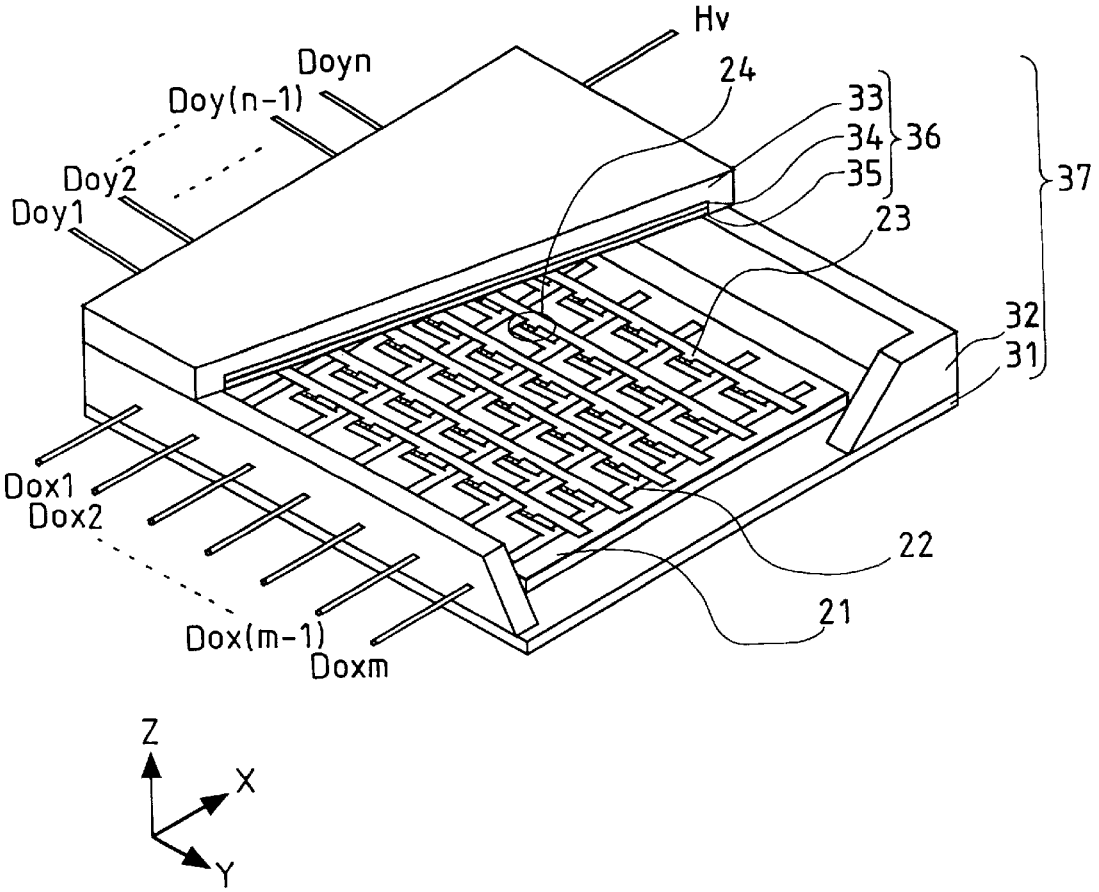
FIG. 8 is a perspective view, partly broken, schematically showing an image-forming apparatus using the electron source of matrix wiring type.
Figure 9A:
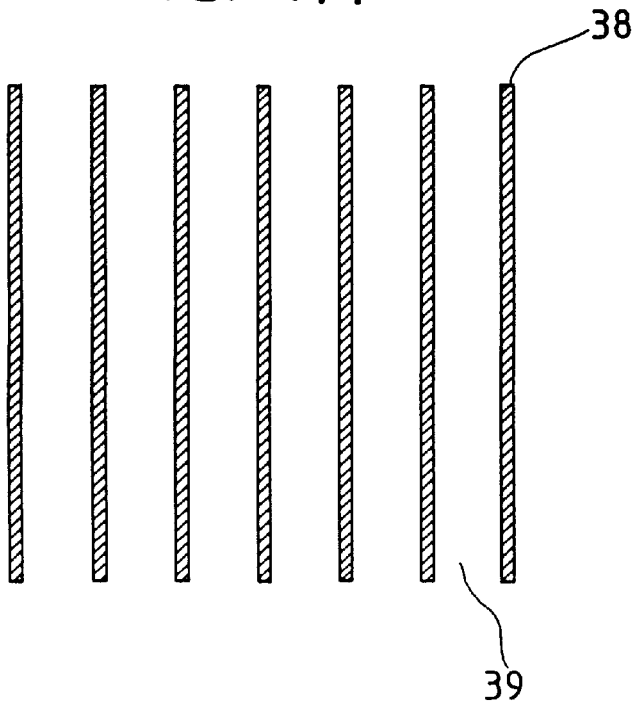
FIGS. 9A and 9B are schematic views for explaining arrangements of a fluorescent substance film.
Figure 9B:
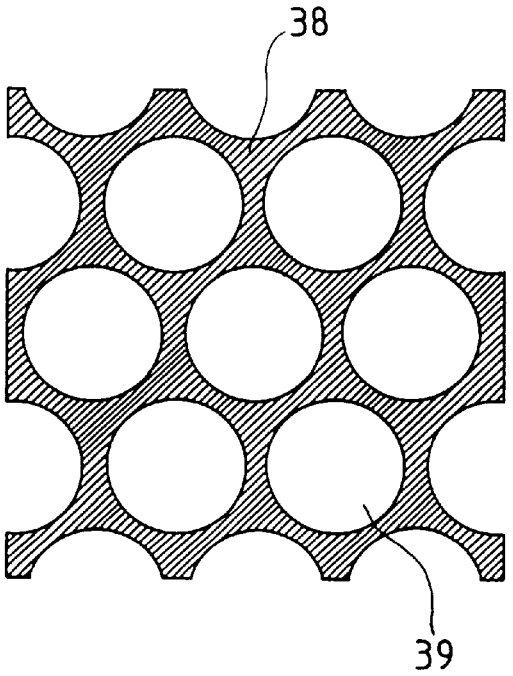
Figure 10:
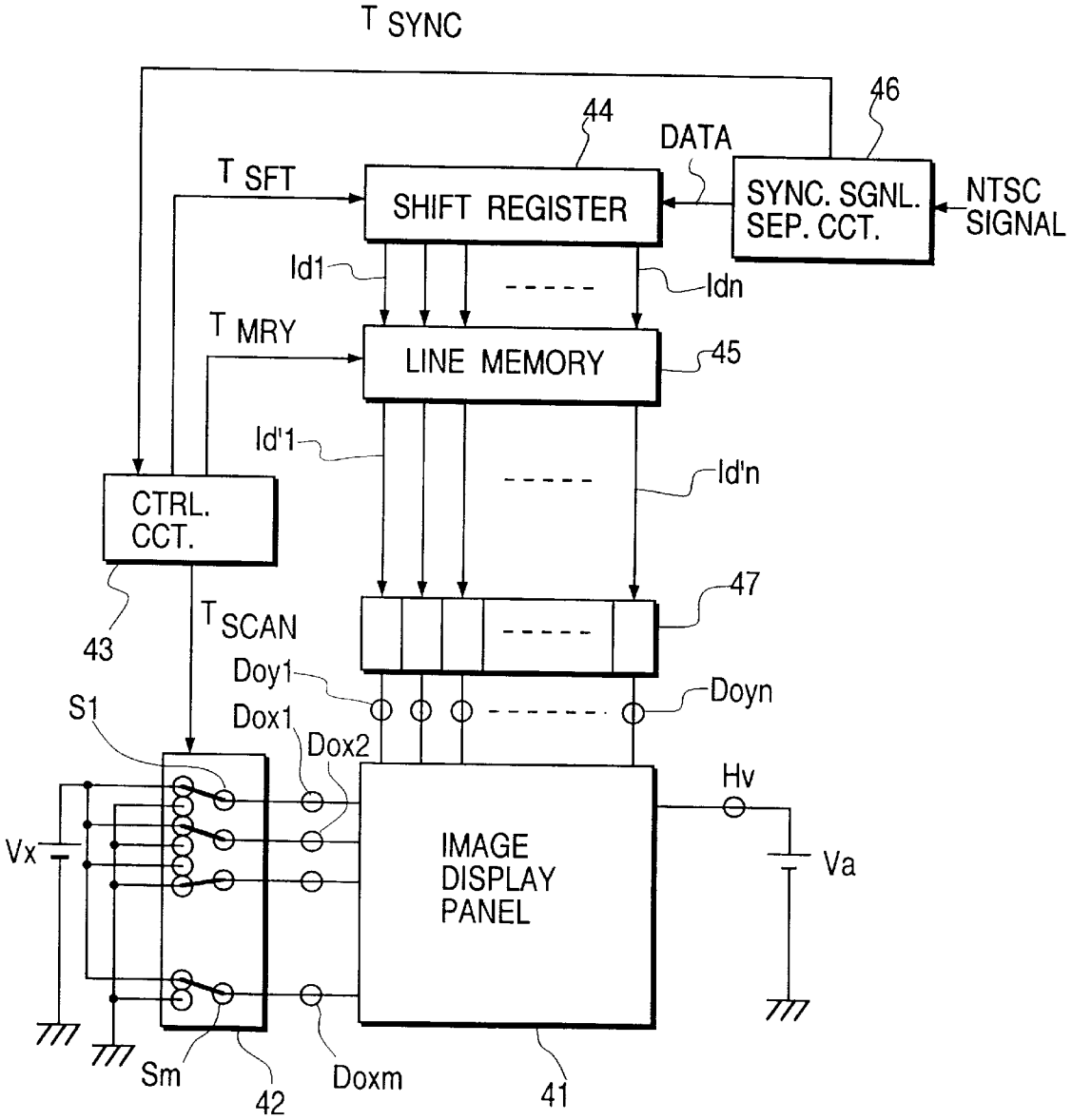
FIG. 10 is a block diagram for explaining a driving method of an image-forming apparatus using the electron source of matrix wiring type.

A description will now be made, with reference to FIGS. 8, 9A, 9B and 10, of an image-forming apparatus constructed by using the above electron source of simple matrix wiring type. FIG. 8 is a schematic perspective view showing one example of a display panel of the image-forming apparatus, FIGS. 9A and 9B are schematic views of fluorescent films for use in the image-forming apparatus of FIG. 8, and FIG. 10 is a block diagram showing one example of a driving circuit adapted to display an image in accordance with TV signals of NTSC standards.

In FIG. 8, denoted by 21 is an electron source base plate on which a number of electron-emitting devices are arrayed, 31 is a rear plate to which the electron source base plate 21 is fixed, 36 is a face plate fabricated by laminating a fluorescent film 34, a metal back 35, etc. on an inner surface of a glass base plate 33, and 32 is a support frame. The rear plate 31 and the face plate 36 are joined to the support frame 32 by applying frit glass or the like and baking it in an atmosphere of air or nitrogen gas at a temperature ranging from 400° C. to 500° C. for 10 minutes or more, thereby hermetically seal the joined portions to make up an envelope 37.

Incidentally, reference numeral 24 represents surface conduction electron-emitting devices and 22, 23 represent, respectively, X- and Y-directional wires connected to respective ones of the paired device electrodes of the surface conduction electron-emitting devices.

The envelope 37 is made up by the face plate 36, the support frame 32 and the rear plate 31 as mentioned above. However, since the rear plate 31 is provided for the purpose of mainly reinforcing the strength of the base plate 21, the rear plate 31 as a separate member can be dispensed with if the base plate 21 itself has a sufficient degree of strength. In this case, the support frame 32 may directly be joined to the base plate 21 in a hermetically sealed manner, thereby making up the envelope 37 by the face plate 36, the support frame 32 and the base plate 21. Alternatively, a not-shown support called a spacer may be disposed between the face plate 36 and the rear plate 31 so that the envelope 37 has a sufficient degree of strength against the atmospheric pressure.

FIGS. 9A and 9B schematically show examples of the fluorescent film 34. The fluorescent film 34 can be formed of a fluorescent substance alone for monochrome display. For color display, the fluorescent film 34 is formed by a combination of black conductors 38 and fluorescent substances 39, the black conductors 38 being called black stripes or a black matrix depending on patterns of the fluorescent substances. The purpose of providing the black stripes or black matrix is to provide black areas between the fluorescent substances 39 in three primary colors necessary for color display, so that color mixing becomes less conspicuous and a reduction in contrast caused by reflection of exterior light by the fluorescent film 34 is suppressed. The black stripes or the like can be made of not only materials containing graphite as a main ingredient which are usually employed in the art, but also any other materials which are electroconductive and have small transmittance and reflectance to light.

Fluorescent substances can be coated on the glass base plate 33 by precipitation, printing or the like regardless of whether the image is monochrome or colored. On an inner surface of the fluorescent film 34, the metal back 35 is usually provided. The metal back has functions of increasing the luminance by mirror-reflecting light, that is emitted from the fluorescent substances to the inner side, toward the face plate 36, serving as an electrode to apply a voltage for accelerating electron beams, and protecting the fluorescent substances from being damaged by collisions with negative ions produced in the envelope. The metal back can be fabricated, after forming the fluorescent film, by smoothing an inner surface of the fluorescent film (this step being usually called filming) and then depositing Al thereon by vacuum vapor deposition, for example.

To increase electrical conductivity of the fluorescent film 34, the face plate 36 may include a transparent electrode (not shown) provided on an outer surface of the fluorescent film 34.

Before hermetically sealing off the envelope as explained above, careful alignment must be performed in the case of color display so that the fluorescent substances in respective colors and the electron-emitting devices are precisely positioned corresponding to each other.

The image-forming apparatus shown in FIG. 8 is manufactured, by way of example, as follows.

As with the treatment step explained above, the envelope 37 is evacuated through an evacuation tube (not shown) by an evacuation apparatus which uses no oil, such as an ion pump or a sorption pump, while properly heating it if necessary, to thereby establish an atmosphere at a vacuum degree of about $10^{-5}$ Pa where an amount of remained organic materials is sufficiently small. Then, the envelop 37 is hermetically sealed off. To maintain such a vacuum degree in the sealed envelope 37, the envelope may be subjected to gettering. This process is performed by, immediately before or after sealing off the envelope 37, heating a getter disposed in a predetermined position (not shown) within the envelope 37 by resistance heating or high-frequency heating so as to form an vapor deposition film of the getter. The getter usually contains Ba as a primary component. The inner space of the envelope can be maintained at a vacuum degree in the range of $1\times10^{-4}$ to $1\times10^{-5}$ Pa by the adsorbing action of the vapor deposition film. Incidentally, the steps subsequent to the forming treatment of the surface conduction electron-emitting devices are appropriately set.

One exemplary configuration of a driving circuit for displaying a TV image in accordance with TV signals of NTSC standards on a display panel constructed by using the electron source of simple matrix wiring type will be described below with reference to FIG. 10. In FIG. 10, denoted by 41 is an image display panel, 42 is a scanning circuit, 43 is a control circuit, 44 is a shift register, 45 is a line memory, 46 is a synch signal separating circuit, 47 is a modulation signal generator, and Vx and Va are DC voltage sources.

The display panel 41 is connected to the external electrical circuits through terminals Dox1 to Doxm, terminals Doy1 to Doyn, and a high-voltage terminal Hv. Applied to the terminals Dox1 to Doxm is a scan signal for successively driving the electron source provided in the display panel, i.e., a group of surface conduction electron-emitting devices wired into a matrix of M rows and N columns, on a row-by-row basis (i.e., in units of N devices).

On the other hand, applied to the terminals Doy1 to Doyn is a modulation signal for controlling electron beams output from the surface conduction electron-emitting devices in one row selected by the scan signal. The high-voltage terminal Hv is supplied with a DC voltage of 10 kV, for example, from the DC voltage source Va. This DC voltage serves as an accelerating voltage for giving the electron beams emitted from the surface conduction electron-emitting devices energy enough to excite the corresponding fluorescent substances.

The scanning circuit 42 will now be described. The scanning circuit 42 includes a number M of switching devices (symbolically shown by S1 to Sm in FIG. 10). Each of the switching devices selects an output voltage of the DC voltage source Vx or 0 V (ground level), and is electrically connected to corresponding one of the terminals Doxl to Doxm of the display panel 41. The switching devices SI to Sm are operated in accordance with a control signal Tscan output by the control circuit 43, and are easily made up by a combination of typical switching devices such as FETS.

The DC voltage source Vx outputs a constant voltage set in this embodiment based on characteristics of the surface conduction electron-emitting devices (i.e., electron-emitting threshold voltage) so that the driving voltage applied to the devices not under scanning is kept lower than the electron-emitting threshold voltage.

The control circuit 43 functions to make the various components operated in match with each other so as to properly display an image in accordance with video signals input from the outside. Thus, in accordance with a synch signal Tsyn supplied from the synch signal separating circuit 46, the control circuit 43 generates control signals Tscan, Tsft and Tmry for the associated components.

The synch signal separating circuit 46 is a circuit for separating a synch signal component and a luminance signal component from an NTSC TV signal applied from the outside, and can be made up using ordinary frequency separators (filters) or the like. The synch signal separated by the synch signal separating circuit 46 comprises a vertical synch signal and a horizontal synch signal, but it is here represented by the signal Tsync for convenience of description. Also, the video luminance signal component separated from the TV signal is represented by a signal DATA for convenience of description. The signal DATA is input to the shift register 44.

The shift register 44 carries out serial/parallel conversion of the signal DATA, which is time-serially input to the register, for each line of an image. The shift register 44 is operated by the control signal Tsft supplied from the control circuit 43 (hence, the control signal Tsft can be said as a shift clock for the shift register 44). Data for one line of the image (corresponding to data for driving the number N of electron-emitting devices) resulted from the serial/parallel conversion is output from the shift register 44 as a number N of parallel signals Idl to Idn.

The line memory 45 is a memory for storing the data for one line of the image for a period of time as long as required. The line memory 45 stores the contents of the parallel signals Idl to Idn in accordance with the control signal Tmry supplied from the control circuit 43. The stored contents are output as I'dl to I'dn and applied to the modulation signal generator 47.

The modulation signal generator 47 is a signal source for properly driving the surface conduction electron-emitting devices in accordance with the respective video data I'dl to I'dn in a modulated manner. Output signals from the modulation signal generator 47 are applied to the corresponding surface conduction electron-emitting devices in the display panel 41 through the terminals Doy1 to Doyn.

As described above, the electron-emitting devices to which the present invention is applicable each have basic characteristics below with regards to the emission current Ie. Specifically, the electron-emitting device has a definite threshold voltage Vth for emission of electrons and emits electrons only when a voltage exceeding Vth is applied. In addition, for the voltage exceeding the electron emission threshold, the emission current is also changed depending on changes in the voltage applied to the device. Therefore, when a pulse-like voltage is applied to the device, no electrons are emitted if the applied voltage is lower than the electron emission threshold value, but an electron beam is produced if the applied voltage exceeds the electron emission threshold value. On this occasion, the intensity of the produced electron beam can be controlled by changing a crest value Vm of the pulse. Further, the total amount of charges of the produced electron beam can be controlled by changing a width Pw of the pulse.

Thus, the electron-emitting device can be modulated in accordance with an input signal by a voltage modulating method, a pulse width modulating method and so on. In the case of employing the voltage modulating method, the modulation signal generator 47 can be realized by using a circuit of voltage modulation type which generates a voltage pulse having a fixed length and modulates a crest value of the voltage pulse in accordance with input data.

In the case of employing the pulse width modulating method, the modulation signal generator 47 can be realized by using a circuit of pulse width modulation type which generates a voltage pulse having a fixed crest value and modulates a width of the voltage pulse in accordance with input data.

The shift register 44 and the line memory 45 may be designed to be adapted for any of digital signals and analog signals. Anyway, it is essential that the serial/parallel conversion and storage of video signals be effected at a predetermined speed.

For digital signal design, it is required to convert the signal DATA output from the synch signal separating circuit 46 into a digital signal, but this can easily be realized just by incorporating an A/D converter in an output portion of the circuit 46. Further, depending on whether the output signal of the line memory 45 is digital or analog, the circuit used for the modulation signal generator 47 must be designed in somewhat different ways. More specifically, when the voltage modulating method using a digital signal is employed, the modulation signal generator 47 is constituted by, e.g., a D/A converter and, if necessary, may additionally include an amplifier, etc. When the pulse width modulating method using a digital signal is employed, the modulation signal generator 47 is constituted by a circuit in combination of, for example, a high-speed oscillator, a counter for counting the number of waves output from the oscillator, and a comparator for comparing an output value of the counter and an output value of the line memory. In this case, if necessary, an amplifier for amplifying a voltage of the modulation signal, which is output from the comparator and has a modulated pulse width, to the driving voltage for the surface conduction electron-emitting devices may also be added.

On the other hand, when the voltage modulating method using an analog signal is employed, the modulation signal generator 47 can be constituted by an amplifier using, e.g., an operational amplifier and, if necessary, may additionally include a level shift circuit. When the pulse width modulating method using an analog signal is employed, the modulation signal generator 47 can be constituted by a voltage controlled oscillator (VCO), for example. In this case, if necessary, an amplifier for amplifying a voltage of the modulation signal to the driving voltage for the surface conduction electron-emitting devices may also be added.

In the thus-arranged image-forming apparatus of the present invention, electrons are emitted by applying a voltage to the electron-emitting devices through the terminals Dox1 to Doxm and Doy1 to Doyn extending outwardly of the envelope. The electron beams are accelerated by applying a high voltage to the metal back 35 or the transparent electrode (not shown) through the high-voltage terminal Hv. The accelerated electrons impinge against the fluorescent film 34 which generates fluorescence to form an image.

The above-explained arrangements of the image-forming apparatus are one example of image-forming apparatus to which the present invention is applicable, and can be modified in various ways based on the technical concept of the present invention. The input signal is not limited to an NTSC TV signal mentioned above, but may be any of other TV signals of PAL and SECAM standards, including another type of TV signal (e.g., so-called high-quality TV signal of MUSE-standards) having the larger number of scan lines than the above types.

An electron source of ladder wiring type and an image-forming apparatus using such an electron source will now be described with reference to FIGS. 21 and 19.

Figure 21:
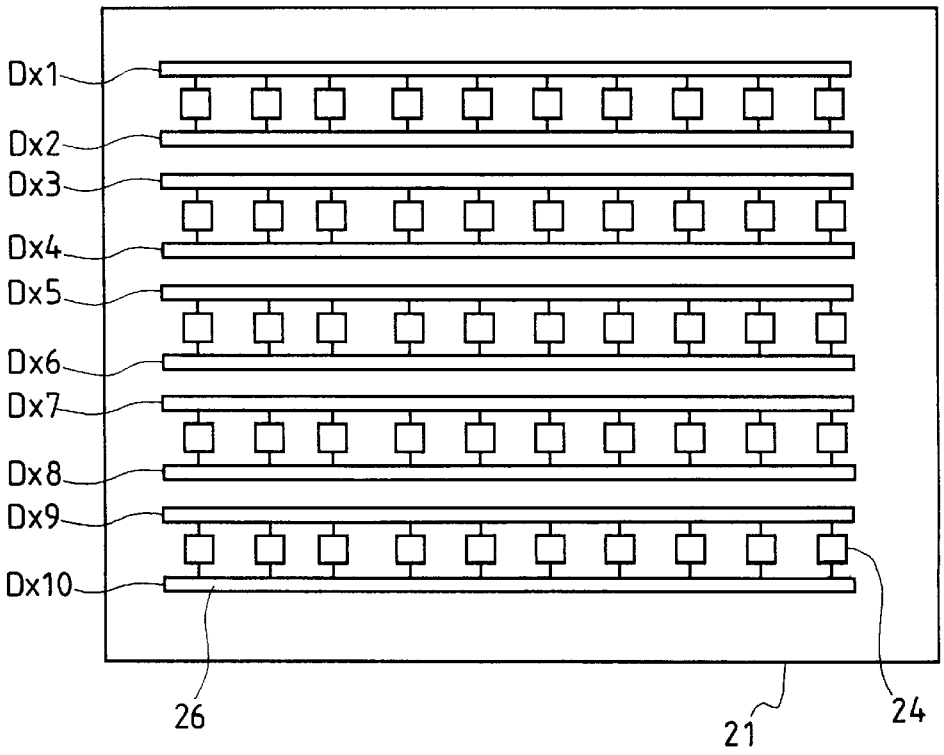
FIG. 21 is a schematic view showing arrangements of the electron source of ladder wiring type.

FIG. 21 is a schematic view showing one example of the electron source of ladder wiring type. In FIG. 21, denoted by 21 is an electron source base plate, 24 is an electron-emitting device, and 26 or Dx1 to Dx10 are common wires for interconnecting the electron-emitting devices 24. A plurality of electron-emitting devices 24 are arrayed on the base plate 21 side by side to line up in the X-direction (a resulting row of the electron-emitting devices being called a device row). This device row is arranged in plural number to make up an electron source. By properly applying a driving voltage to between the common wires of each device row, respective device rows can be driven independently of one another. Specifically, a voltage exceeding the electron emission threshold value is applied to the device rows from which electron beams are to be emitted, whereas a voltage lower than the electron emission threshold value is applied to the device rows from which electron beams are not to be emitted. Incidentally, those pairs of the common wires Dx2 to Dx9 which are located between two adjacent device rows, e.g., Dx2 and Dx3, may be each formed as a single wire.

Figure 19:
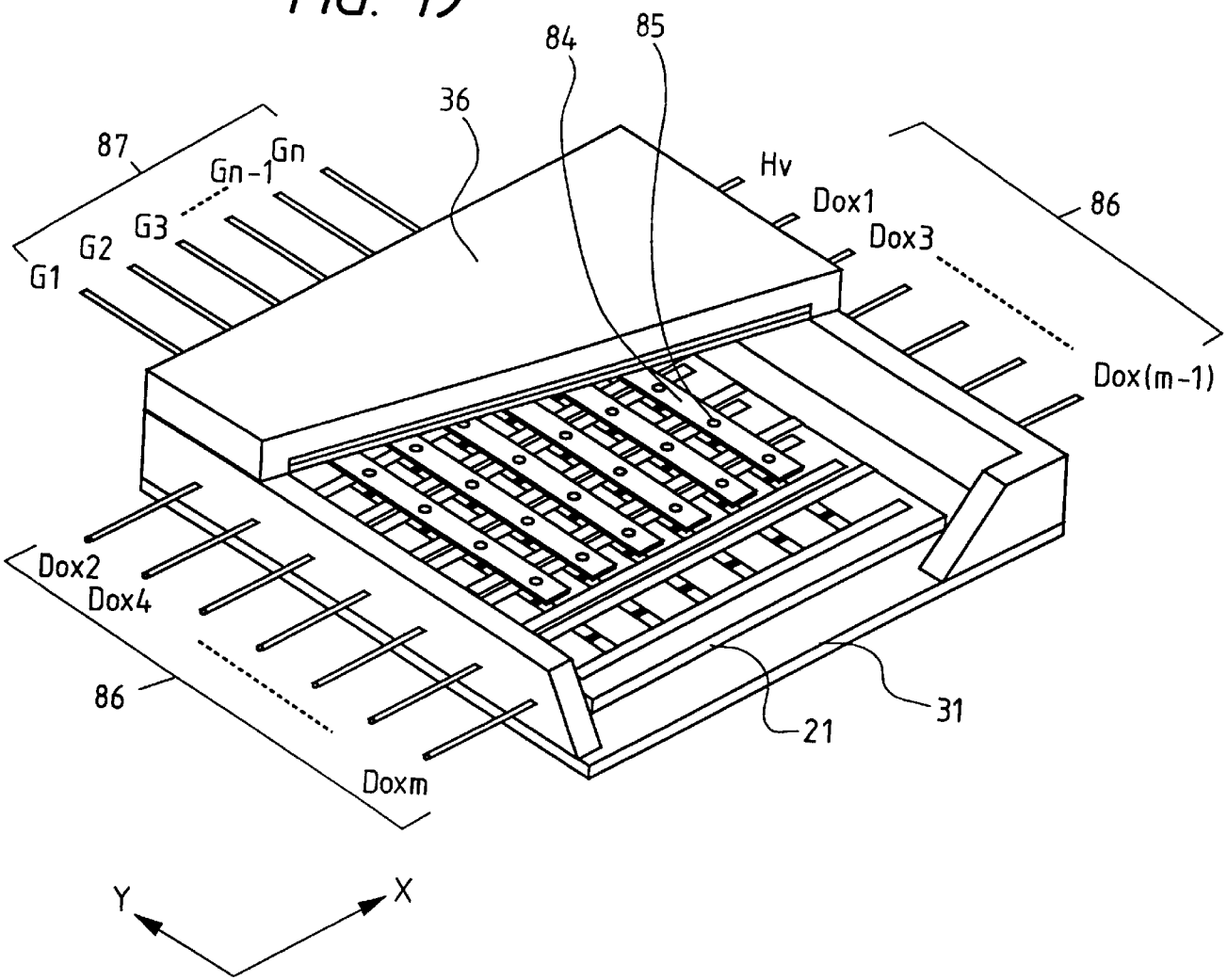
FIG. 19 is a perspective view, partly broken, schematically showing an image-forming apparatus using the electron source of ladder wiring type.
Figure 20:
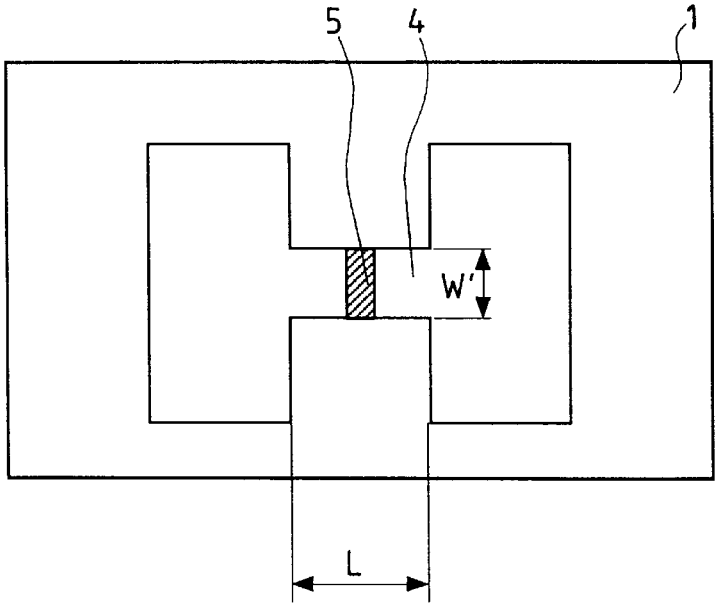
FIG. 20 PRIOR ART
FIG. 20 is a schematic view showing the structure of a prior art device proposed by M. Hartwell et al.

FIG. 19 is a schematic view showing one example of the panel structure of the image-forming apparatus including the electron source of ladder wiring type. Denoted by 84 is a grid electrode, 85 is an aperture for allowing electrons to pass therethrough, 86 are terminals extending out of the envelope as indicated by Dox1, Dox2, . . . , Doxm, 87 are terminals extending out of the envelope as indicated by G1, G2, . . . , Gn and connected to the corresponding grid electrodes 84, and 21 is an electron source base plate. Note that, in FIG. 19, the same reference numerals as those in FIGS. 8, 11A and 11B denote identical members. The image-forming apparatus of this embodiment is principally different from the image-forming apparatus of simple matrix wiring type shown in FIG. 8 in that the grid electrodes 84 are interposed between the electron source base plate 21 and the face plate 36.

The grid electrodes 84 serve to modulate electron beams emitted from the surface conduction electron-emitting devices. The grid electrodes 84 are stripe-shaped electrodes extending perpendicularly to the device rows in the ladder wiring, and have circular apertures 85 formed therein for passage of the electron beams in one-to-one relation to the electron-emitting devices. The shape and set position of the grid electrodes are not necessarily limited to ones illustrated in FIG. 19. For example, the apertures may be a large number of mesh-like small openings, or may be positioned in surroundings or vicinity of the surface conduction electron-emitting devices.

The external terminals 86 and the external grid terminals 87 both extending out of the envelop are electrically connected to a control circuit (not shown).

In the image-forming apparatus of this embodiment, irradiation of the electron beams upon fluorescent substances can be controlled to display an image on a line-by-line basis by simultaneously applying modulation signals for one line of the image to each row of the grid electrode in synch with the device rows being driven (scanned) successively on a row-by-row basis.

The image-forming apparatus of the present invention can be employed as not only a display for TV broadcasting, but also displays for TV conference systems, computers, etc., including an image-forming apparatus for an optical printer made up by a photosensitive drum and so on.

The present invention will be described below in connection with Examples.

EXAMPLE 1

An electron-emitting device of this Example has the same structure as shown in FIGS. 1A and 1B. A manufacture process of the electron-emitting device of this Example will be described below with reference to FIGS. 3A to 3D.

(Step a)

A silicon oxide film being 0.5 $\mu$m thick was formed on a cleaned soda lime glass by sputtering to prepare the base plate 1. A photoresist (RD-2000N-41, by Hitachi Chemical Co., Ltd.) was formed and patterned on the base plate 1. A Ti film being 5 nm thick and an Ni film being 100 nm thick were then deposited thereon in this order by vacuum vapor deposition. The photoresist pattern was dissolved by an organic solvent to leave the deposited Ni/Ti films by lift-off, thereby forming the device electrodes 2, 3. The spacing L between the device electrodes was set to L=3 $\mu$m and the width W of each device electrode was set to W=300 $\mu$m.

(Step b)

To form the electroconductive thin film 4, a Cr mask was formed as follows. A Cr film being 100 nm thick was deposited by vacuum vapor deposition on the base plate 1 having the device electrodes 2, 3 formed thereon, and openings were defined corresponding to the shape of the electroconductive thin film 4 by the ordinary photolithography process. The Cr film was thereby formed.

Then, a paradium (Pd) amine complex solution (ccp-4230, by Okuno Pharmaceutical Co., Ltd.) was coated on the base plate under rotation by using a spinner, followed by heating for calcination in air at 300° C. for 10 minutes. The thus-formed film was a fine particle film containing PdO as a primary component and having a thickness of 10 nm.

(Step c)

The Cr mask was removed by wet etching. The PdO fine particle film was patterned by lift-off to form the electroconductive thin film 4 in the desired form. The electroconductive thin film 4 had a resistance value $R_s$ of $2\times10^4$ Ω/□.

(Step d)

Next, the device was transferred into the vacuum treatment apparatus, doubling as the measuring/evaluating apparatus, shown in FIG. 5 for the forming treatment. The forming treatment was performed by evacuating the interior of the vacuum vessel 15 by the evacuation device 16 until reaching a pressure of $2.3\times10^{-3}$ Pa and, thereafter, applying a pulse voltage to between the device electrodes 2 and 3.

The evacuation device used in this Example was the so-called ultra-high vacuum evacuation system comprising a sorption pump and an ion pump. In the following description, if not otherwise specified, such an ultra-high vacuum evacuation system was employed as the evacuation device.

Voltage pulses used for the forming treatment had the waveform as shown in FIG. 4B in which the pulse width was T1=1 msec. and the pulse interval was T2=10 msec. A crest value of the triangular waveform was raised in steps of 0.1 V. A rectangular pulse (not shown) of 0.1 V was inserted between one forming pulse and next one to carry out the forming while monitoring a resistance value. The forming treatment was finished at the time the resistance value exceeded 1 MΩ. The crest value (i.e., the forming voltage) upon the completion was 5.0 to 5.1 V.

(Step e)

$WF_6$ was introduced to the vacuum vessel 15 through a slow leak valve 17, and the pressure in the vacuum vessel 15 was adjusted to be held at $1.3\times10^{-1}$ Pa. Triangular pulses having a crest value of 14 V was then applied to the device for activation treatment. The pulse width and interval were set to the same ones as used in the above forming treatment. With the activation treatment, a tungsten (W) film was formed in the electron-emitting region. During the activation treatment, the pulse voltage was applied while measuring the device current If and the emission current Ie. In this Example, because the electron emission efficiency η (=Ie/If) reached a maximum after about 30 minutes, the introduction of $WF_6$ stopped and the activation treatment was finished then. The determination as to whether the electron emission efficiency reached a maximum or not was made by calculating η from the measured results of Ie and If, calculating the time differential ∂η/∂t of η, and determining the point in time at which the differential value was staying around 0 for one minute.

EXAMPLE 2

After following Example 1 until Step d, $H_2$ was introduced to the vacuum vessel together with $WF_6$ in Step e. The remaining steps were the same as in Example 1. A partial pressure of $H_2$ was adjusted to $1.3\times10^{-2}$ Pa.

Comparative Example 1

After following Example 1 until Step d, the activation treatment was performed as follows.

(Step e)

In this Comparative Example, the vacuum vessel was evacuated by an ultra-high vacuum evacuation system comprising a rotary pump and a turbo pump, and the pressure in the vacuum vessel was adjusted to about $2.7\times10^{-4}$ Pa. Triangular pulses having a crest value of 14 V was then applied to the device for activation treatment. With the activation treatment, the emission current Ie and the device current If were drastically increased. During the activation treatment, the pulse voltage was applied while measuring the device current If and the emission current Ie.

After performing the activation treatment for 30 minutes, the pulse application was stopped and the evacuation system was switched to the same ultra-high vacuum evacuation system as in Example 1, followed by continuing evacuation while heating the vacuum vessel to about 200° C. Upon confirming that the pressure in the vacuum vessel reached $1.3\times10^{-6}$ Pa, heating of the vacuum vessel was stopped and the activation treatment was finished.

Electron emission characteristics and time-dependent changes thereof of Examples 1, 2 and Comparative Example 1 were measured. During the measurement, the pressure in the vacuum vessel was maintained at $1.3\times10^{-6}$ Pa. Voltage pulses applied to the devices for measurement were rectangular pulses of 14 V with the pulse width of T1=100 psec. and the pulse interval of T2=10 msec. Ie was measured by setting the distance between the anode electrode and the device to 4 mm and the voltage to 1 kV.

The devices were continuously driven for 100 hours during which time changes in the emission current Ie were measured.

One of the devices fabricated in plural number for each of Examples 1, 2 and Comparative Example 1 was not subjected to the measurement and the topography of its electron-emitting region was observed by using a scannig electron microscope (SEM). Further, to evaluate crystallinity of the coating film of W, electron beam diffraction of the coating film was observed to confirm whether a diffraction pattern appeared or not.

The measured results of the emission current Ie are below.

| | Ie(initial) (μA) | Ie(100 h) (μA) | Ratio (%) |
|---|---|---|---|
| Example 1 | 1.6 | 1.1 | 69 |
| Example 2 | 1.8 | 1.4 | 78 |
| Com. Ex. 1 | 1.5 | 0.5 | 33 |

Figure 13A:
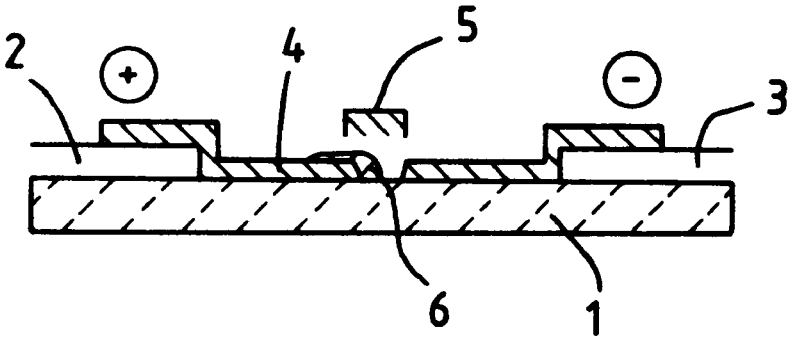
FIGS. 13A to 13C are schematic views showing arrangements of an electron-emitting region fissure and coating films made primarily of a metal in the electron-emitting device of the present invention.

As a result of the observation by SEM, it was confirmed that the coating film of W was formed on the high potential (positive electrode) side of the electron-emitting fissure for both the devices of Examples 1 and 2, as depicted in FIG. 13A. On the low potential (negative electrode) side, no appreciable coating film was found. For some of the devices fabricated under conditions similar to those in this Example, a slight coating film was also found on the low potential side depending on the conditions, as depicted in FIG. 13C.

Results of the electron beam diffraction measurement were as follows. A crystalline portion exhibiting a clear diffraction pattern and an amorphous portion for which a halo was observed were mixed in Example 1, whereas a clear diffraction pattern of W was observed in Example 2. It was also confirmed that the peak shape was somewhat sharper in Example 2 than in the crystalline portion of Example 1, and a higher degree of crystallinity was achieved in Example 2. These results are presumably due to that the hydrogen introduced in the step of forming the coating film serves as etching gas and only crystals of W having good crystallinity have grown.

EXAMPLE 3

After following Example 1 until Step d, the activation treatment was performed as follows.

(Step e)

Figure 11A:
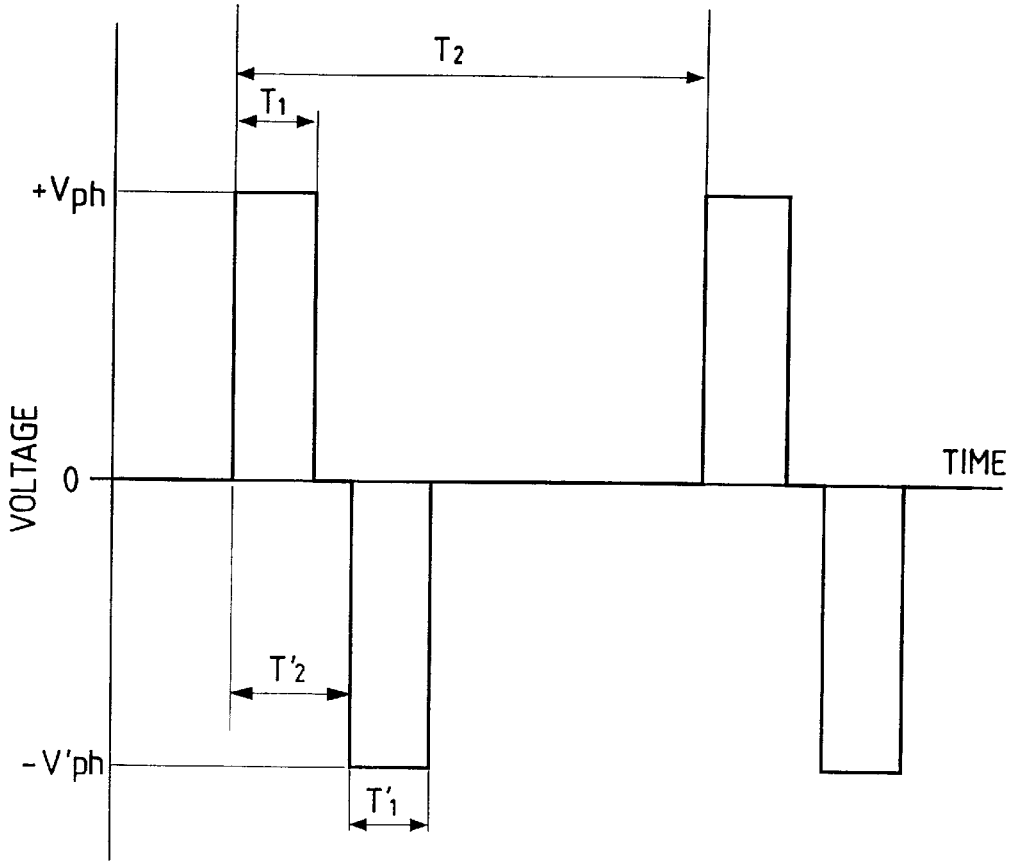
FIGS. 11A and 11B are charts showing waveforms of rectangular pulses used in the manufacture process according to the present invention and for evaluation of characteristics.

$WF_6$ was introduced to the vacuum vessel through the slow leak valve, and the pressure in the vacuum vessel was adjusted to be held at $1.3\times10^{-3}$ Pa. Rectangular pulses having a crest value of 14 V and polarity alternately switched over, as shown in FIG. 11A, was then applied to the device for activation treatment. The pulse width T1, T'1 and period T2 were 1 msec. and 10 msec., respectively, and the interval T'2 between the pulses of opposite polarities was 5 msec.

At the time the electron emission efficiency η reached a maximum, the treatment was stopped and the interior of the vacuum vessel was continuously evacuated to hold the pressure at $1.3\times10^{-6}$ Pa or below.

EXAMPLE 4

The device was fabricated following Example 3 except that $H_2$ was introduced to the vacuum vessel together with $WF_6$ in Step e. A partial pressure of $WF_6$ was adjusted to $1.3\times10^{-3}$ Pa and a partial pressure of $H_2$ was adjusted to $1.3\times10^{-4}$ Pa.

The devices of Examples 3 and 4 were subjected to measurement of electron emission characteristics, observation of topography by SEM, and measurement of electron beam diffraction. Conditions for measuring the electron emission characteristics were the same as those set for Examples 1, 2 and Comparative Example 1. The results are below.

| | Ie(initial) (μA) | Ie(100 h) (μA) | Ratio (%) |
|---|---|---|---|
| Example 3 | 1.7 | 1.2 | 71 |
| Example 4 | 2.0 | 1.6 | 80 |

Figure 13B:
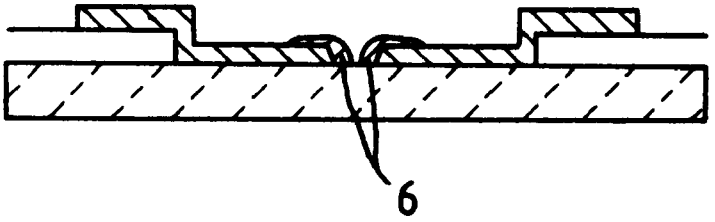
Figure 13C:
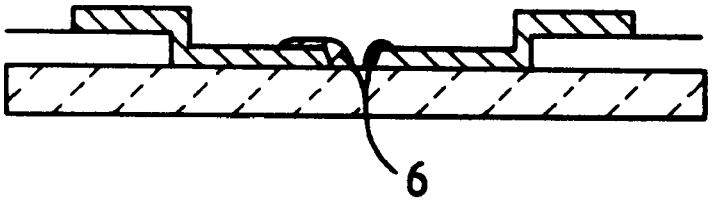
Figure 14A:
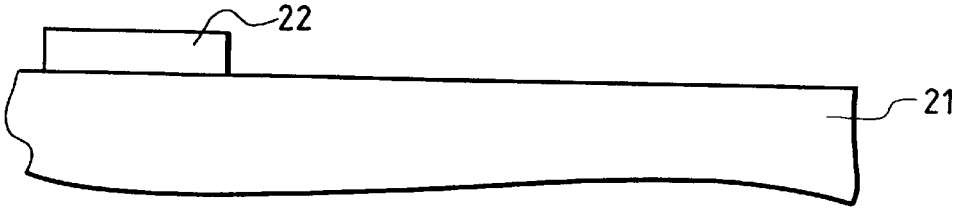
FIGS. 14A to 14H are sectional views for explaining a manufacture process of the electron source of matrix wiring type.
Figure 14B:
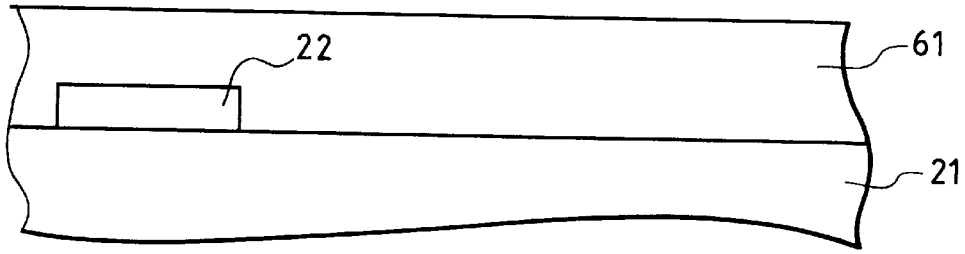
Figure 14C:
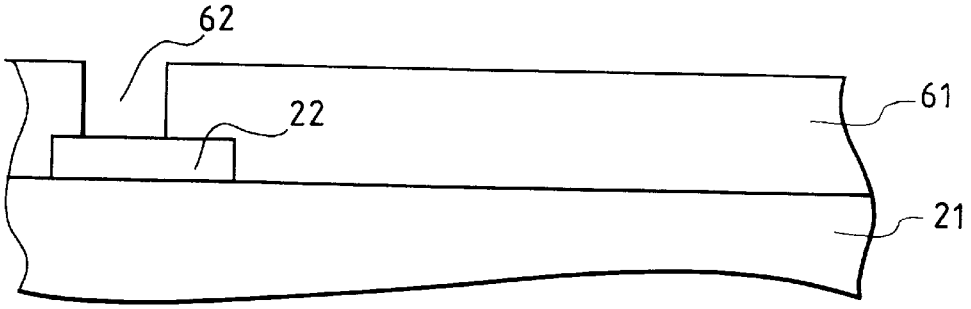
Figure 14D:
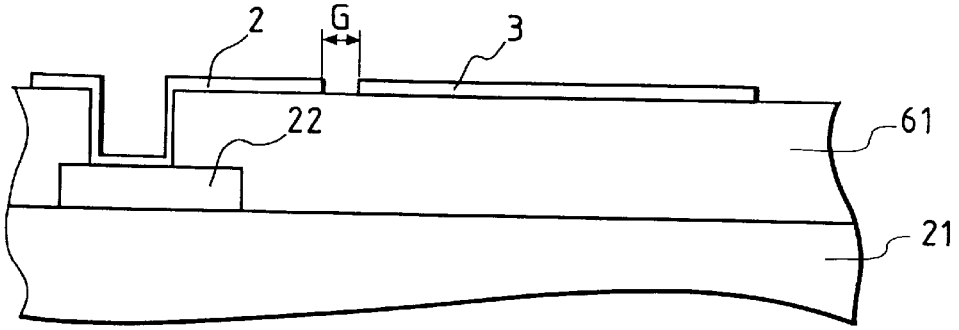
Figure 14E:
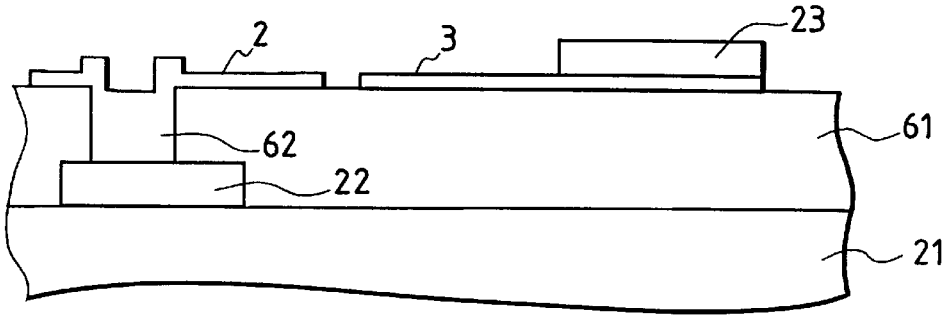
Figure 14F:
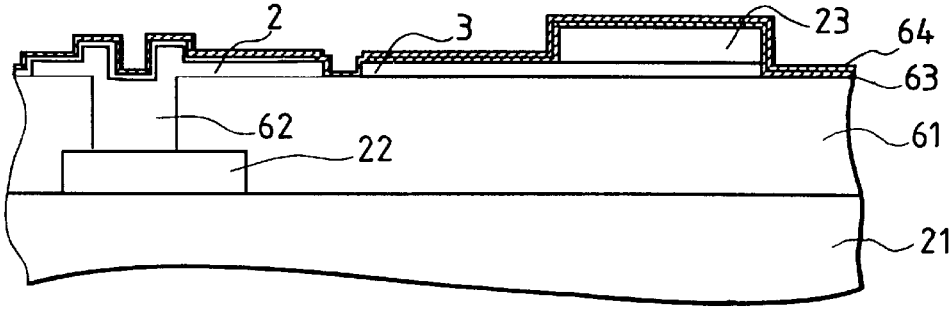
Figure 14G:
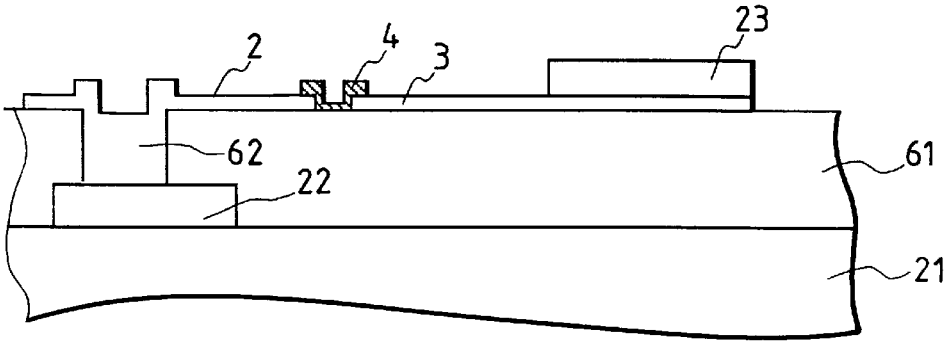
Figure 14H:
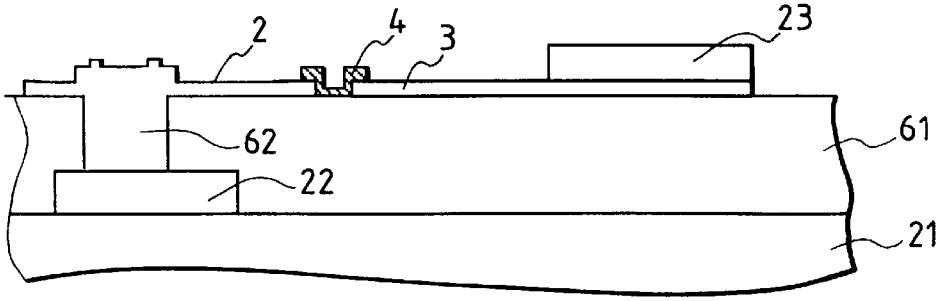

As a result of the topography observation by SEM, it was confirmed that coating films of W were likewise formed on both the high and low potential sides for the devices of Examples 3 and 4, as depicted in FIG. 13B. Results of the electron beam diffraction were that a portion exhibiting a clear diffraction pattern of crystals and a portion for which a halo was observed were mixed in Example 1 as with Example 1, whereas a clear diffraction pattern of crystals was observed in Example 4 as with Example 2.

EXAMPLE 5

After following Example 1 until Step d, the activation treatment was performed as follows.

(Step e)

Figure 11B:
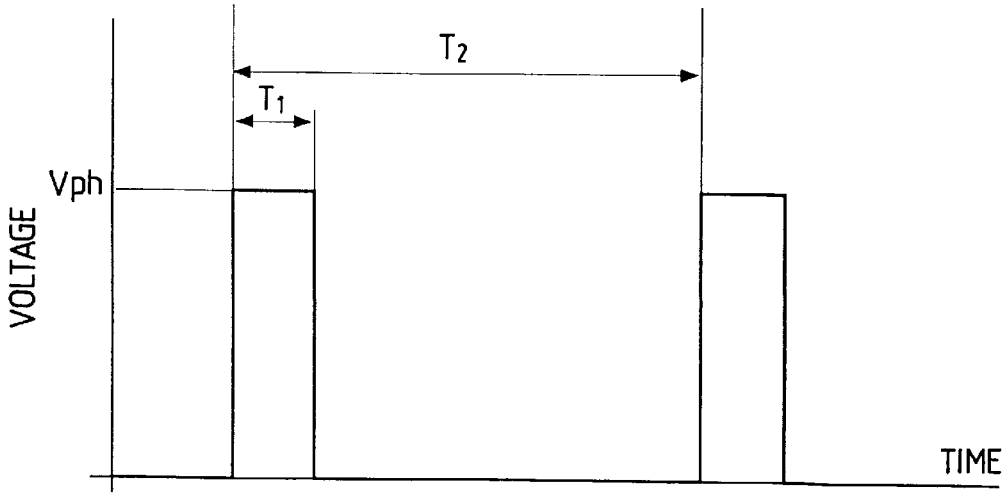

$W(CO)_6$ was introduced to the vacuum vessel by opening the slow leak valve, and the pressure in the vacuum vessel was adjusted to be held at $1.3\times10^{-2}$ Pa. Rectangular pulses having a crest value of 14 V, as shown in FIG. 11B, was then applied to the device for activation treatment. The pulse width T1 and interval T2 were 3 msec. and 10 msec., respectively. With the activation treatment, a tungsten film was formed in the electron-emitting region. During the activation treatment, the pulse voltage was applied while measuring the device current If and the emission current Ie.

At the time the electron emission efficiency η reached a maximum, the pulse application and the introduction of $W(CO)_6$ were stopped and the interior of the vacuum vessel was continuously evacuated to hold the pressure at $1.3\times10^{-6}$ Pa or below.

EXAMPLE 6

The device was fabricated under the same conditions as in Example 5 except that the pulses applied in Step e were rectangular pulses of 18 V.

EXAMPLE 7

The device was fabricated under the same conditions as in Example 5 except that $H_2$ was introduced to the vacuum vessel together with $W(CO)_6$ in Step e. A partial pressure of $W(CO)_6$ was adjusted to $1.3\times10^{-3}$ Pa and a partial pressure of $H_2$ was adjusted to $1.3\times10^{-4}$ Pa.

The devices of Examples 5 to 7 were subjected to measurement of electron emission characteristics under the same conditions as in Example 1. The results are below.

| | Ie(initial) (μA) | Ie(100 h) (μA) | Ratio (%) |
|---|---|---|---|
| Example 5 | 1.4 | 0.9 | 65 |
| Example 6 | 1.8 | 1.2 | 67 |
| Example 7 | 1.8 | 1.3 | 72 |

As a result of topography observation by SEM, it was confirmed that, for any of the devices, a coating film of W was formed on the high potential side of the electron-emitting region as with Example 2.

EXAMPLE 8

After following Example 1 until Step d, the activation treatment was performed as follows.

(Step e)

$W(C_5H_5)_2H_2$ was introduced to the vacuum vessel by opening the slow leak valve, and the pressure in the vacuum vessel was adjusted to be held at $1.3\times10^{-2}$ Pa. Rectangular pulses having a crest value of 18 V, as shown in FIG. 11B, was then applied to the device for activation treatment. The pulse width T1 and interval T2 were 3 msec. and 10 msec., respectively. With the activation treatment, a tungsten film was formed in the electron-emitting region. During the activation treatment, the pulse voltage was applied while measuring the device current If and the emission current Ie.

At the time the electron emission efficiency η reached a maximum, the pulse application and the introduction of $W(C_5H_5)_2H_2$ were stopped.

The device of this Example was subjected to measurement of electron emission characteristics under the same conditions as in Example 1. The results are below.

| | Ie(initial) (μA) | Ie(100 h) (μA) | Ratio (%) |
|---|---|---|---|
| Example 8 | 1.9 | 1.2 | 63 |

As a result of topography observation by SEM, it was confirmed that a coating film was formed on the high potential side of the electron-emitting region as with Example 1. As a result of examining composition of the coating film by an electron probe microanalyzer (EPMA), it was found that the coating film contained a substantial amount of carbon in addition to W.

EXAMPLE 9

After following Example 1 until Step d, the activation treatment was performed as follows.

(Step e)

$Mo(CO)_6$ was introduced to the vacuum vessel by opening the slow leak valve, and the pressure in the vacuum vessel was adjusted to be held at $1.3\times10^{-3}$ Pa. Rectangular pulses having a crest value of 16 V, as shown in FIG. 11B, was then applied to the device for activation treatment. The pulse width T1 and interval T2 were 3 msec. and 10 msec., respectively. With the activation treatment, a molybdenum film was formed in the electron-emitting region. During the activation treatment, the pulse voltage was applied while measuring the device current If and the emission current Ie.

At the time the electron emission efficiency η reached a maximum, the pulse application and the introduction of $Mo(CO)_6$ were stopped and the interior of the vacuum vessel was continuously evacuated to hold the pressure at $1.3\times10^{-6}$ Pa or below.

EXAMPLE 10

After following Example 1 until Step d, the activation treatment was performed as follows.

(Step e)

$Hf(C_5H_5)_2H_2$ was introduced to the vacuum vessel by opening the slow leak valve, and the pressure in the vacuum vessel was adjusted to be held at $1.3\times10^{-3}$ Pa. Rectangular pulses having a crest value of 18 V, as shown in FIG. 11B, was then applied to the device for activation treatment. The pulse width T1 and interval T2 were 3 msec. and 10 msec., respectively. With the activation treatment, a hafnium film was formed in the electron-emitting region. During the activation treatment, the pulse voltage was applied while measuring the device current If and the emission current Ie.

At the time the electron emission efficiency η reached a maximum, the pulse application and the introduction of $Hf(C_5H_5)_2H_2$ were stopped.

The devices of Examples 9 to 10 were subjected to measurement of electron emission characteristics under the same conditions as in Example 1. The results are below.

| | Ie(initial) (μA) | Ie(100 h) (μA) | Ratio (%) |
|---|---|---|---|
| Example 9 | 1.6 | 1.0 | 63 |
| Example 10 | 2.0 | 1.2 | 60 |

As a result of topography observation by SEM, it was confirmed that, for any device of Examples 9 and 10, a coating film was formed on the high potential side of the electron-emitting region.

EXAMPLE 11

After following Example 1 until Step d, the activation treatment was performed as follows.

(Step e)

Figure 12:
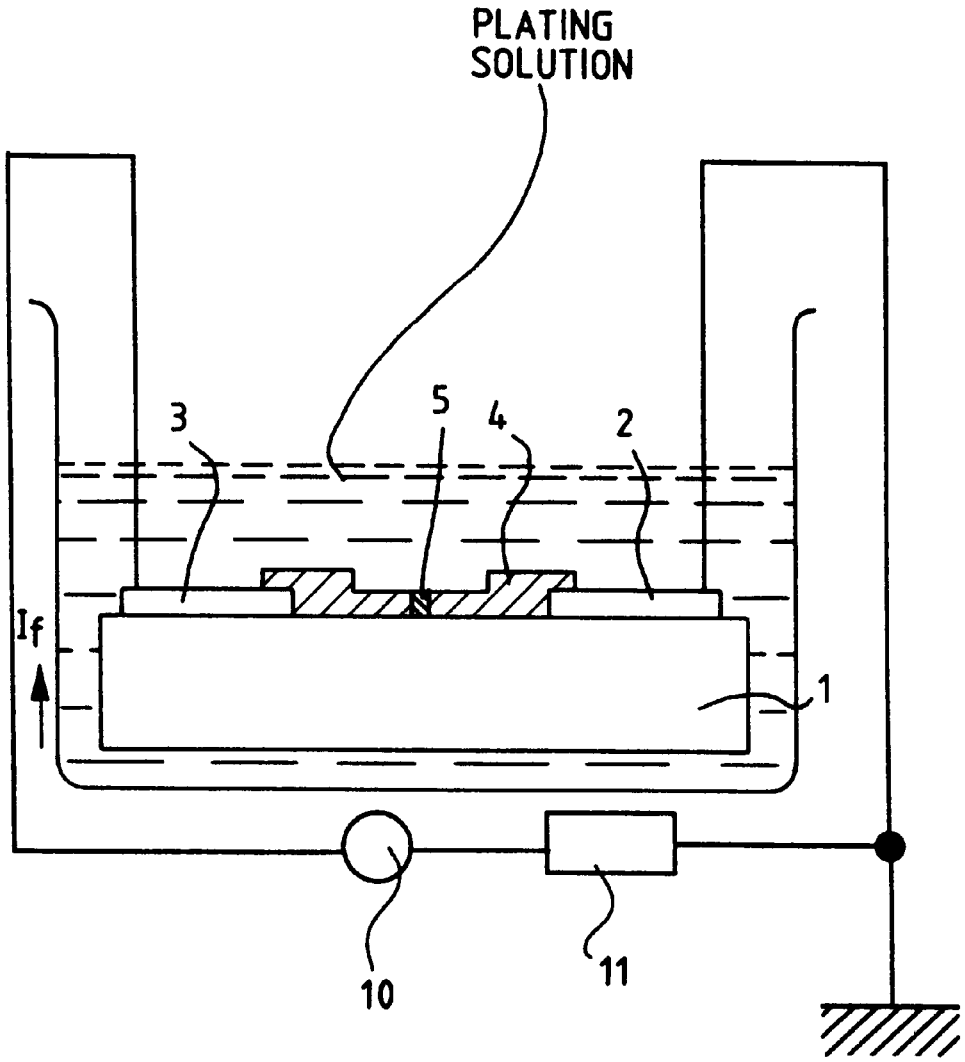
FIG. 12 is a diagram of an electrolytic plating apparatus used in the manufacture process according to the present invention.

The device was immersed in a plating solution filled in a plated film forming apparatus schematically shown in FIG. 12 to form a metal film by plating. Electrolyte plating was performed by applying triangular pulses having a crest value of 10 V with the device electrodes 2, 3 serving as negative and positive electrodes, respectively. Consulting Takashi Omi, Masaru Batate and Hisashi Yamamoto, "Surface Technology", Vol. 40, No. 2311-316 (1989), the composition of the plating solution was made up of $Na_2WO_4\cdot{}_2H_2O$; 40 g/l, $NiS_4.6H_2O$; 70 g/l and citric acid; 80 g/l, and was adjusted to pH 6 by using $NH_4OH$.

At the time the current flowing through the device reached 5 mA, the pulse application was stopped, followed by washing and drying the device.

With the above activation treatment, a coating film made of an alloy of W and Ni was formed primarily on the side of the device electrode 2 in the electron-emitting region formed by the Forming.

The devices of this Example 11 was subjected to measurement of electron emission characteristics under the same conditions as in Example 1. The measurement was performed by rearranging the device electrodes 2, 3 to serve as positive and negative electrodes, respectively, in opposition to the polarities in the plating step. The interior of the vacuum vessel was evacuated to hold the pressure at $1.3\times10^{-6}$ Pa or below. The measured results are below.

| | Ie(initial) ($\mu$A) | Ie(100 h) ($\mu$A) | Ratio (%) |
|---|---|---|---|
| Example 11 | 1.7 | 1.1 | 65 |

EXAMPLE 12

In this Example, the present invention was applied to manufacture of the electron source comprising a number of surface conduction electron-emitting devices arrayed on a base plate and interconnected in matrix wiring as schematically shown in FIG. 7, and also to manufacture of an image-forming apparatus using the electron source. The number of devices is 100 for each of X- and Y-directions.

The manufacture process will be described below with reference to FIGS. 14A to 14H.

Step A

A silicon oxide film being 0.5 $\mu$m thick was formed on a cleaned soda lime glass by sputtering to prepare the base plate 1. A Cr film being 5 nm thick and an Au film being 600 nm thick were then laminated on the base plate 1 in this order by vacuum vapor deposition. A photoresist (AZ1370, by Hoechst Co.) was coated thereon under rotation by using a spinner and then baked. Thereafter, by exposing and developing a photomask image, a resist pattern for lower wires 22 was formed. The deposited Au/Cr films were selectively removed by wet etching to thereby form the lower wires 22 in the desired pattern.

Step B

Then, an interlayer insulating layer 61 formed of a silicon oxide film being 1.0 $\mu$m thick was deposited over the entire base plate by RF sputtering.

Step C

A photoresist pattern for forming the contact holes 62 in the silicon oxide film deposited in Step B was coated and, by using it as a mask, the interlayer insulating layer 61 was selectively etched to form the contact holes 62. The etching was carried out by the RIE (Reactive Ion Etching) process using a gas mixture of $CF_4$ and $H_2$.

Step D

A photoresist (RD-2000N-41, by Hitachi Chemical Co., Ltd:) was formed in a pattern to define device electrodes 2, 3 and electron emitting regions G therebetween. A Ti film being 5 nm thick and an Ni film being 100 nm thick were then deposited thereon in this order by vacuum vapor deposition. The photoresist pattern was dissolved by an organic solvent to leave the deposited Ni/Ti films by lift-off. The device electrodes 2, 3 each having the electrode width of 300 $\mu$m with the electron emitting regions G of 3 $\mu$m between were thereby formed.

Step E

A photoresist pattern for upper wires 23 was formed on the device electrodes 2 and 3. A Ti film being 5 nm thick and an Au film being 500 nm thick were then deposited thereon in this order by vacuum vapor deposition. The unnecessary photoresist pattern was removed to form the upper wires 23 by lift-off.

Step F

Next, a Cr film 63 being 30 nm thick was deposited by vacuum vapor deposition and patterned to have openings corresponding to the shape of an electroconductive thin film 64. A paradium (Pd) amine complex solution (ccp4230) was coated thereon under rotation by using a spinner and then heated for calcination at 300° C. for 12 minutes. The electroconductive thin film 64 made up of PdO fine particles was thereby formed and had a film thickness of 70 nm.

Step G

The Cr film 63 was etched away by wet etching using an etchant along with unnecessary portions of the electroconductive thin film 64 made up of PdO fine particles. The electroconductive thin film 64 in the desired pattern was thereby formed and had a resistance value $R_s$ of $4\times10^4$ Ω/□.

Step H

A resist was coated in a pattern to cover the surface other than the contact holes 62. A Ti film being 5 nm thick and an Au film being 500 nm thick were then deposited thereon in this order by vacuum vapor deposition. Unnecessary portions were removed to make the contact holes 62 filled with the deposits by lift-off.

An image-forming apparatus was constructed by using the electron source thus fabricated. The manufacture process of the image-forming apparatus will be described with reference to FIG. 8.

Step I

The electron source base plate 21 was fixed onto a rear plate 31. Then, a face plate 36 (comprising a fluorescent film 34 and a metal back 35 laminated on an inner surface of a glass base plate 33) was disposed 5 mm above the base plate 21 with the intervention of a support frame 32 between and, after applying frit glass to joined portions between the face plate 36, the support frame 32 and the rear plate 31, the assembly was baked in an atmosphere of air or nitrogen gas at 400° C. to 500° C. for 10 minutes or more for hermetically sealing the joined portions. Frit glass was also used to fix the base plate 21 to the rear plate 31. In FIG. 8, denoted by 24 is an electron-emitting device and 22, 23 are X- and Y-directional wires, respectively.

The fluorescent film 34 is formed of only a fluorescent substance in the monochrome case. For producing a color image, this Example employed a stripe pattern of fluorescent substances. Thus, the fluorescent film 34 was fabricated by first forming black stripes and then coating fluorescent substances in respective colors in gaps between the black stripes. The black stripes were formed by using a material containing graphite as a primary component which is conventionally employed in the art. Fluorescent substances were coated on the glass base plate 33 by the slurry method.

On the inner surface of the fluorescent film 34, the metal back 35 is usually disposed. After forming the fluorescent film, the metal back 35 was fabricated by smoothing the inner surface of the fluorescent film (this step being usually called filming) and then depositing Al thereon by vacuum vapor deposition.

To increase electrical conductivity of the fluorescent film 34, the face plate 36 may be provided with a transparent electrode (not shown) on an outer side of the fluorescent film 34 in some cases. Such a transparent electrode was omitted in this Example because sufficient electrical conductivity was obtained with the metal back alone.

Before the above hermetic sealing, alignment of the respective parts was carried out with due care since the fluorescent substances in respective colors and the electron-emitting devices must be precisely aligned with each other in the color case.

Step J

Figure 15:
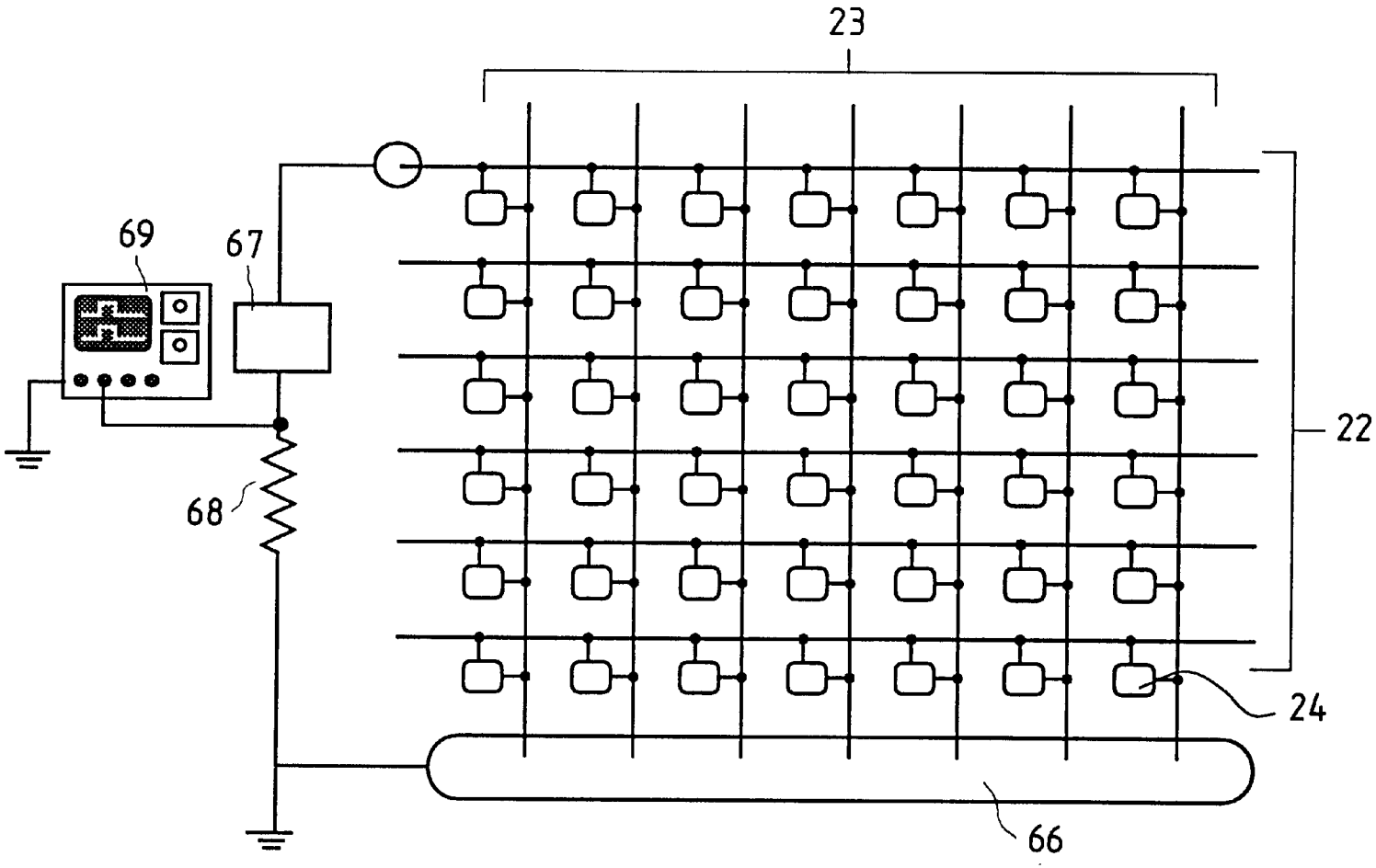
FIG. 15 is a diagram for explaining the electrical connection for Forming treatment performed in the manufacture process of the electron source of matrix wiring type.

The atmosphere in the glass envelope thus completed was evacuated by a vacuum pump through an evacuation tube to a vacuum degree of about $10^{-4}$ Pa. As shown in FIG. 15, the forming treatment was performed on a line-on-line base by interconnecting the Y-directional wires 23. In FIG. 15, denoted by 66 is a common electrode for interconnecting the Y-directional wires 23, 67 is a power supply, 68 is a resistor for measuring a current, and 69 is an oscilloscope for monitoring the current.

Step K

Figure 16:
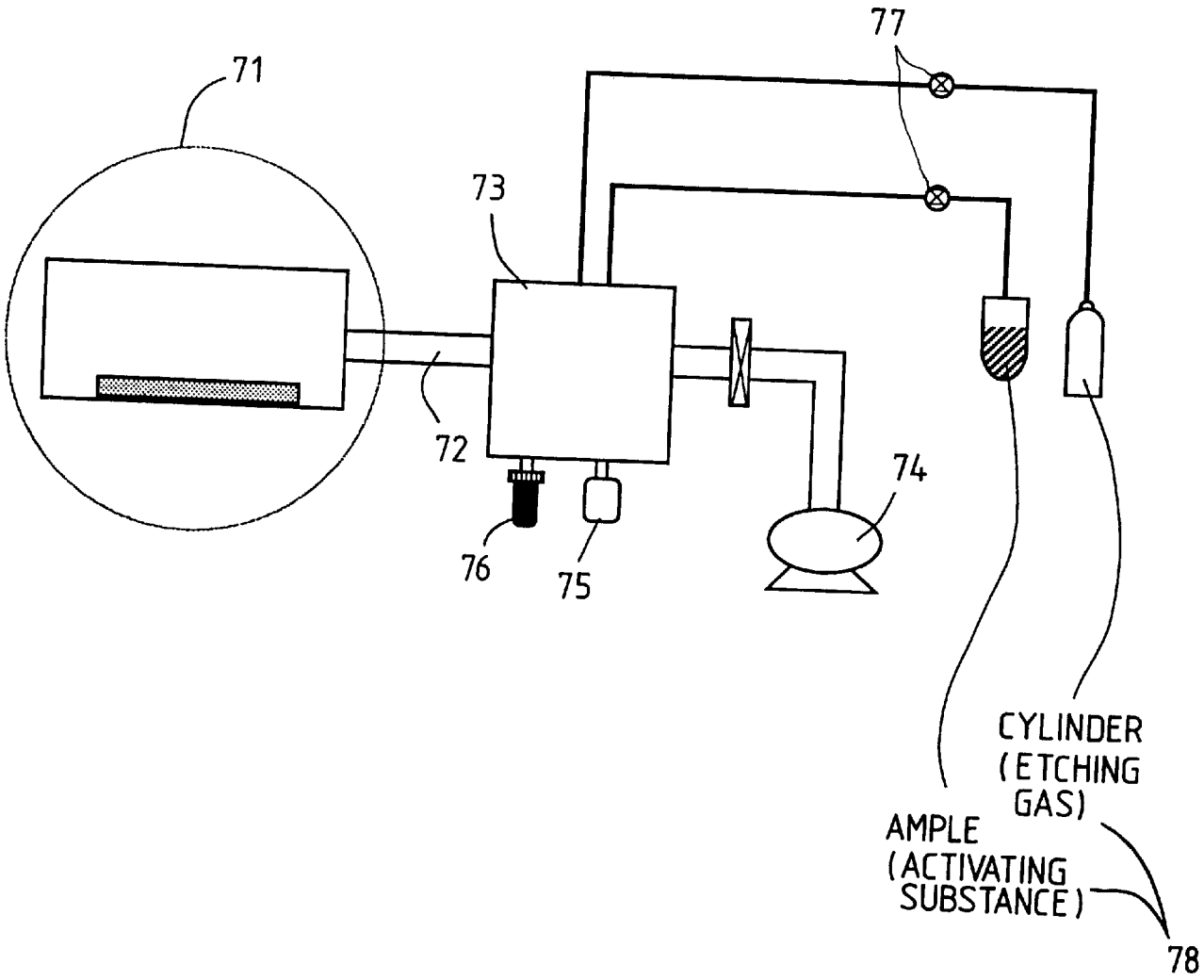
FIG. 16 is a diagram showing a vacuum treatment apparatus used in the manufacture process of the image-forming apparatus of the present invention.

Subsequently, a coating film was formed. The configuration of a treatment apparatus is shown in FIG. 16. An image-forming apparatus 71 is connected to a vacuum chamber 73 through an evacuation tube 72. The vacuum chamber 73 is evacuated by an evacuation device 74 and the atmosphere therein is detected by a pressure gauge 75 and a quadruple mass spectrometer (Q-mass) 76. Connected to the vacuum chamber 73 are two gas introducing systems one of which is used to introduce an activating material and the other of which is used to introduce a material (etching gas) for etching the activating material. In this Example, the etching gas introducing system was not employed.

The activating material introducing system is connected to a material source 78 through a gas introducing unit 77 comprising a solenoid valve and a mass flow controller. In this Example, the material source 78 was prepared by filling $W(CO)_6$ in an ampule and then vaporizing it.

The gas introducing unit 77 was controlled for introducing $W(CO)_6$ to the panel (envelope) and the pressure in the envelope was adjusted to $1.3\times10^{-4}$ Pa, followed by applying rectangular pulses of 18 V. The pulse width and interval were set to 3 msec. and 10 msec., respectively.

The activation treatment was performed on row-by-row basis. Rectangular pulses having a crest value Vact=18 V were applied to each of the X-directional wires connected to one row of devices, and all the Y-directional wires were connected to the common electrode as with above Step J.

At the time the device current If flowing through one row increased to meet If >200 mA (2 mA per device), the activation treatment for that row was finished, followed by treating a next row. Thus, the activation treatment was repeated likewise until the last row.

Step L

Upon completion of the activation treatment for all the rows, the valve of the gas introducing unit was closed to stop introducing $W(CO)_6$, and the glass envelope was then continuously evacuated for 5 hours while heating the envelope in its entirety to about 200° C. After that, the electron-emitting devices were driven in a simple matrix manner to emit electrons, causing the fluorescent film to generate fluorescence from its entire surface, for confirming that the panel operated normally. After the confirmation, the evacuation tube was heated and melted to be hermetically sealed off. Then, the getter (not shown) placed in the panel was flashed by high-frequency heating.

In the thus-completed image-forming apparatus of the present invention, electrons were emitted by applying the scan signal and the modulation signal to the electron-emitting devices from the respective signal generating means (not shown) through the terminals Dx1 to Dxm and Dy1 to Dyn extending outwardly of the envelope. The electron beams were accelerated by applying a high voltage of 5.0 kV to the metal back 35 through the high-voltage terminal Hv, causing the accelerated electrons to impinge against the fluorescent film 34 which were excited to generate fluorescence to form an image. As a result of continuously driving the panel for 100 hours in a full-surface luminous condition, the state of displaying a good image was maintained during the period.

Figure 17:
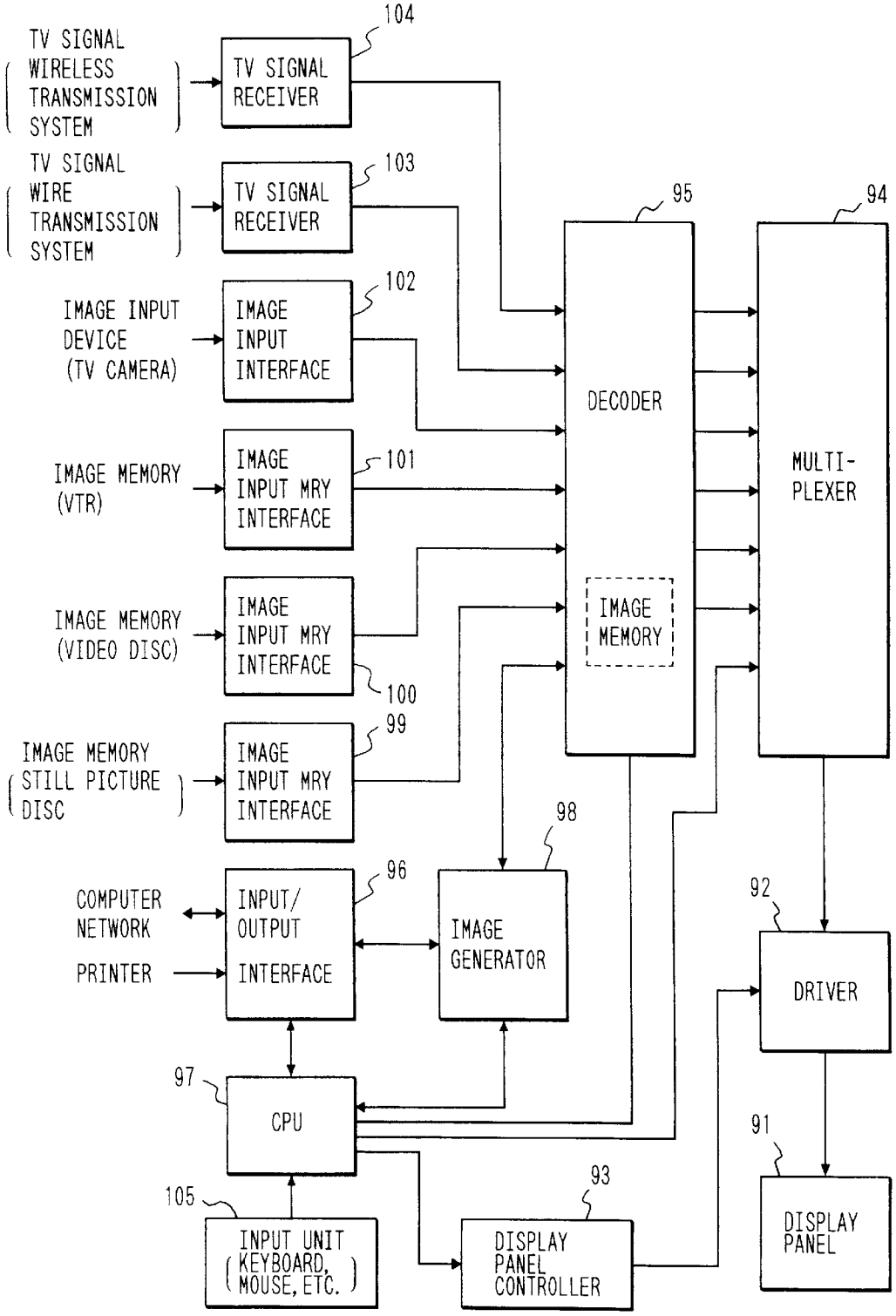
FIG. 17 is a block diagram for explaining one system configuration using the image-forming apparatus of the present invention.

FIG. 17 is a block diagram showing one example of a display device in which the image-forming apparatus (display panel) of Example 12 is arranged to be able to display image information provided from various image information sources including TV broadcasting, for example. In FIG. 17, denoted by 91 is a display panel, 92 is a driver for the display panel, 93 is a display controller, 94 is a multiplexer, 95 is a decoder, 96 is an input/output interface, 97 is a CPU, 98 is an image generator, 99, 100 and 101 are image memory interfaces, $10^2$ is an image input interface, 103 and 104 are TV signal receivers, and 105 is an input unit. (When the present display device receives a signal, e.g., a TV signal, including both video information and voice information, the device of course displays an image and reproduces voices simultaneously. But circuits, a speaker and so on necessary for reception, separation, reproduction, processing, storage, etc. of voice information, which are not directly related to the features of the present invention, will not described here.)

Functions of the above parts will be described below along a flow of image signals.

First, the TV signal receiver 104 is a circuit for receiving a TV image signal transmitted through a wireless transmission system in the form of electric waves or spatial optical communication, for example. A type of the TV signal to be received is not limited to particular one, but may be any type of the NTSC-, PAL- and SECAM-standards, for example. Another type TV signal (e.g., so-called high-quality TV signal including the MUSE-standard type) having the larger number of scan lines than the above types is a signal source fit to utilize the advantage of the display panel which is suitable for an increase in the screen size and the number of pixels. The TV signal received by the TV signal receiver 104 is output to the decoder 95.

Then, the TV signal receiver 103 is a circuit for receiving a TV image signal transmitted through a wire transmission system in the form of coaxial cables or optical fibers. As with the TV signal receiver 104, a type of the TV signal to be received by the TV signal receiver 103 is not limited to particular one. The TV signal received by the receiver 103 is also output to the decoder 95.

The image input interface 102 is a circuit for taking in an image signal supplied from an image input unit such as a TV camera or an image reading scanner, for example. The image signal taken in by the interface 102 is output to the decoder 95.

The image memory interface 101 is a circuit for taking in an image signal stored in a video tape recorder (hereinafter abbreviated to a VTR). The image signal taken in by the interface 210 is output to the decoder 95.

The image memory interface 100 is a circuit for taking in an image signal stored in a video disk. The image signal taken in by the interface 100 is output to the decoder 95.

The image memory interface 99 is a circuit for taking in an image signal from a device storing still picture data, such as a so-called still picture disk. The image signal taken in by the interface 99 is output to the decoder 95.

The input/output interface 96 is a circuit for connecting the display device to an external computer or computer network, or an output device such as a printer. It is possible to perform not only input/output of image data and character/figure information, but also input/output of a control signal and numeral data between the CPU 97 in the display device and the outside in some cases.

The image generator 98 is a circuit for generating display image data based on image data and character/figure information input from the outside via the input/output interface 96, or image data and character/figure information output from the CPU 97. Incorporated in the image generator 98 are, for example, a rewritable memory for storing image data and character/figure information, a read only memory for storing image patterns corresponding to character codes, a processor for image processing, and other circuits required for image generation.

The display image data generated by the image generator 98 is usually output to the decoder 95, but may also be output to an external computer network or a printer via the input/output interface 96 in some cases.

The CPU 97 carries out primarily operation control of the display device and tasks relating to generation, selection and editing of a display image.

For example, the CPU 97 outputs a control signal to the multiplexer 94 for selecting one of or combining ones of image signals to be displayed on the display panel as desired. In this connection, the CPU 97 also outputs a control signal to the display panel controller 72 depending on the image signal to be displayed, thereby properly controlling the operation of the display device in terms of picture display frequency, scan mode (e.g., interlace or non-interlace), the number of scan lines per picture, etc.

Furthermore, the CPU 97 outputs image data and character/figure information directly to the image generator 98, or accesses to an external computer or memory via the input/output interface 96 for inputting image data and character/figure information. It is a matter of course that the CPU 97 may be used in relation to any suitable tasks for other purposes than the above. For example, the CPU 97 may directly be related to functions of producing or processing information as with a personal computer or a word processor. Alternatively, the CPU 97 may be connected to an external computer network via the input/output interface 96, as mentioned above, to execute numerical computations and other tasks in cooperation with external equipment.

The input unit 105 is employed when a user enters commands, programs, data, etc. to the CPU 97, and may be any of various input equipment such as a keyboard, mouse, joy stick, bar code reader, and voice recognition device.

The decoder 95 is a circuit for reverse-converting various image signals input from the circuits 98 to 104 into signals for three primary colors, or a luminance signal, an I signal and a Q signal. As indicated by dot lines in the drawing, the decoder 95 preferably includes an image memory therein. This is because the decoder 95 also handles those TV signals including the MUSE-standard type, for example, which require an image memory for the reverse-conversion. Further, the provision of the image memory brings about an advantage of making it possible to easily display a still picture, or to easily perform image processing and editing, such as thinning-out, interpolation, enlargement, reduction and synthesis of images, in cooperation with the image generator 98 and the CPU 97.

The multiplexer 94 selects a display image in accordance with the control signal input from the CPU 97 as desired. In other words, the multiplexer 94 selects desired one of the reverse-converted image signals input from the decoder 95 and outputs it to the driver 92. In this connection, by switchingly selecting two or more of the image signals in a display time for one picture, different images can also be displayed in plural respective areas defined by dividing one screen as with the so-called multiscreen television.

The display panel controller 93 is a circuit for controlling the operation of the driver 92 in accordance with a control signal input from the CPU 97.

As a function relating to the basic operation of the display panel, the controller 93 outputs to the driver 92 a signal for controlling, by way of example, the operation sequence of a power supply (not shown) for driving the display panel. Also, as a function relating to a method of driving the display panel, the controller 93 outputs to the driver 92 signals for controlling, by way of example, a picture display frequency and a scan mode (e.g., interlace or non-interlace).

Depending on cases, the display panel controller 93 may output to the driver 92 control signals for adjustment of image quality in terms of luminance, contrast, tone and sharpness of the display image.

The driver 92 is a circuit for producing a drive signal applied to the display panel 91. The driver 92 is operated in accordance with the image signal input from the multiplexer 94 and the control signal input from the display panel controller 93.

With the various components arranged as shown in FIG. 17 and having the functions as described above, the display device can display image information input from a variety of image information sources on the display panel 91. More specifically, various image signals including the TV broadcasting signal are reverse-converted by the decoder 95, and at least one of them is selected by the multiplexer 94 upon demand and then input to the driver 92. On the other hand, the display controller 93 issues a control signal for controlling the operation of the driver 92 in accordance with the image signal to be displayed. The driver 92 applies a drive signal to the display panel 91 in accordance with both the image signal and the control signal. An image is thereby displayed on the display panel 91. A series of operations mentioned above are controlled under supervision of the CPU 97.

In addition to simply displaying the image information selected from plural items with the aid of the image memory built in the decoder 95, the image generator 98 and the CPU 97, the present display device can also perform, on the image information to be displayed, not only image processing such as enlargement, reduction, rotation, movement, edge emphasis, thinning-out, interpolation, color conversion, and conversion of image aspect ratio, but also image editing such as synthesis, erasure, coupling, replacement, and inset. Although not especially specified in the description of this embodiment, there may also be provided a circuit dedicated for processing and editing of voice information, as well as the above-explained circuits for image processing and editing.

Accordingly, even a single unit of the present display device can have functions of a display for TV broadcasting, a terminal for TV conferences, an image editor handling still and motion pictures, a computer terminal, an office automation terminal including a word processor, a game machine and so on; hence it can be applied to very wide industrial and domestic fields.

It is needless to say that FIG. 17 only shows one example of the configuration of the display device using the display panel in which the electron source comprises surface conduction electron-emitting elements, and the present invention is not limited to the illustrated example. For example, those circuits of the components shown in FIG. 17 which are not necessary for the purpose of use may be dispensed with. On the contrary, depending on the purpose of use, other components may be added. When the present display device is employed as a TV telephone, it is preferable to provide, as additional components, a TV camera, an audio microphone, an illuminator, and a transmission/reception circuit including a modem.

EXAMPLE 13

Figure 18A:
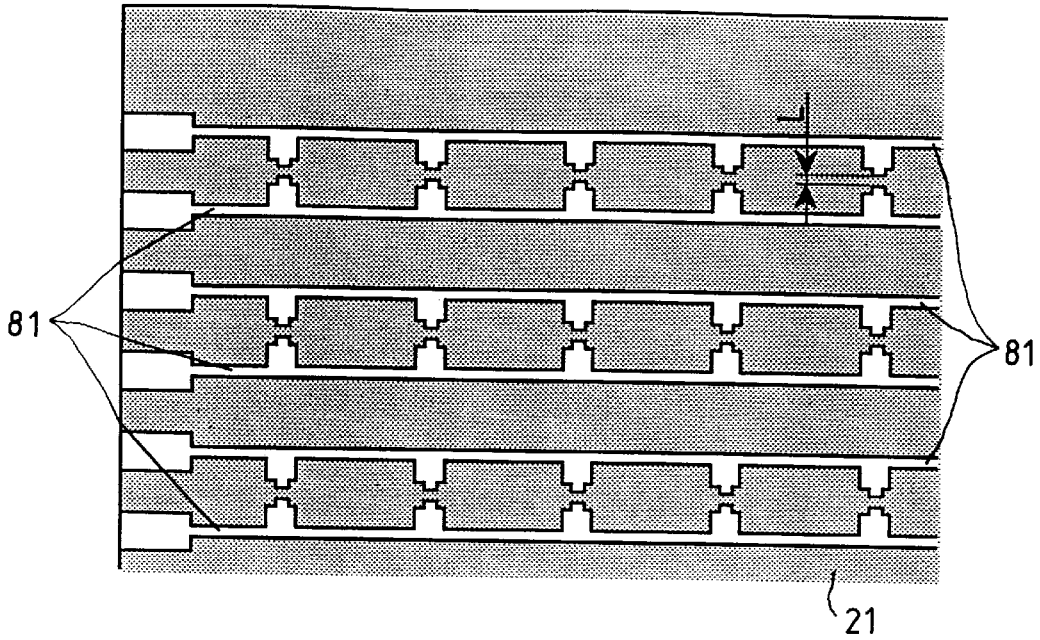
FIGS. 18A to 18C are views for explaining a manufacture process of an electron source of ladder wiring type.
Figure 18B:
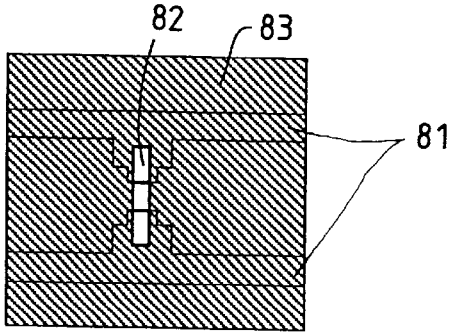
Figure 18C:
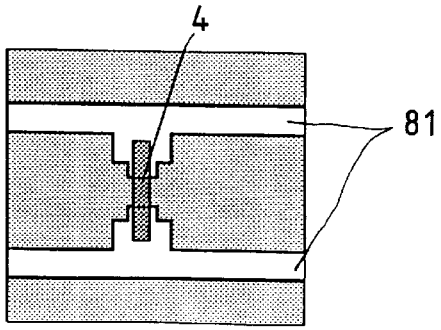

This Example concerns an electron source of ladder wiring type and an image-forming apparatus using the electron source. FIGS. 18A to 18C schematically show part of the following steps. The manufacture process of the electron source and the image-forming apparatus of this Example will be described below. The electron source is constructed by arraying the electron-emitting devices in number 100×100.

Step A

A silicon oxide film being 0.5 μm thick was formed on a cleaned soda lime glass by sputtering to prepare the electron source base plate 21. A photoresist (RD-2000N-41, by Hitachi Chemical Co., Ltd.) was formed and patterned on the base plate 21 to have openings corresponding to the shape of common wires doubling as device electrodes. A Ti film being 5 nm thick and an Ni film being 100 nm thick were then deposited thereon in this order by vacuum vapor deposition. The photoresist pattern was dissolved by an organic solvent to leave the deposited Ni/Ti films by lift-off, thereby forming common wires 81 doubling as the device electrodes. The spacing L between the device electrodes was set to L=3 μm.

Step B

A Cr film being 300 nm thick was deposited by vacuum vapor deposition on the base plate 1, and openings 82 were defined corresponding to the pattern of an electroconductive thin film by the ordinary photolithography process. A Cr mask 83 was thereby formed.

Then, a paradium (Pd) amine complex solution (ccp-4230, by Okuno Pharmaceutical Co., Ltd.) was coated on the base plate under rotation by using a spinner, followed by heating for calcination in air at 300° C. for 12 minutes. The thus-formed film was an electroconductive fine particle film containing PdO as a primary component and having a thickness of about 7 nm.

Step C

The Cr mask was removed by wet etching. The PdO fine particle film was patterned by lift-off to form the electroconductive thin film 4 in the desired form. The electroconductive thin film 4 had a resistance value $R_s$ of $2\times10^4$ Ω/□.

Step D

Next, the base plate was place in the vacuum treatment apparatus shown in FIG. 5 where the Forming treatment was performed on a row-by-row basis. The manner of the forming treatment was set following that used in Example 1. At the time the resistance value of each row exceeded 100 kΩ, the forming treatment for that row was finished, followed by treating a next row.

Step E

The base plate was immersed in the same plating solution as used in Example 11, and rectangular pulses of 10 V was applied to between the wires on the positive and negative electrode sides. The plating was performed on a line-by-line basis. At the time the current flowing through each device reached 5 mA, the plating for that line was finished, followed by plating a next line. In this treatment, the voltage was applied by setting polarities in opposition to those actually set for emission of electrons. As a result, a coating film made of a W—Ni alloy was formed on the negative electrode side in the plating, i.e., the positive electrode side in the actual driving.

Step F

A display panel was fabricated in a like manner to Example 12. However, since the display panel of this Example has a grid electrode, its construction is somewhat different from that in Example 12. The electron source base plate 21, the rear plate 31, the face plate 36 and a grid electrode 84 were assembled, as shown in FIG. 19, with terminals 86 and grid terminals 87 connected to extend outwardly of the envelope. Incidentally, 85 is an aperture for passage of electrons.

As a result of continuously driving the image-forming apparatus (display panels) of Examples 12 and 13 for 100 hours in a full-surface luminous condition, stable performance was maintained in operation of any panel.

As fully described hereinabove, in the electron-emitting devices of the present invention, the electron source using the electron-emitting devices, and the image-forming apparatus using the electron source, deterioration in characteristics of electron emission over long-time driving is suppressed and, hence, stable characteristics of electron emission and stable display functions of images are achieved.

What is claimed is:

1. An electron-emitting device comprising:

a pair of electrodes;

an electroconductive film arranged between said electrodes, said electroconductive film having an electron emitting region including a fissure; and a coating film arranged in said fissure and connected to said electroconductive film to form within said fissure a gap narrower than said fissure, said coating film being made primarily of a material of which melting point is higher than the melting point of said electroconductive film, wherein said material having the higher melting point is a metal or a mental oxide.

2. An electron-emitting device according to claim 1, wherein said coating film is arranged on an end, facing said fissure, of said electroconductive film positioned on the high potential side.

3. An electron-emitting device according to claim 2, wherein said coating film is also arranged on another end, facing said fissure, of said electroconductive film positioned on the low potential side.

4. An electron-emitting device according to claim 1, wherein said material having the higher melting point is a metal made up of an element selected from a group of elements belonging to Groups IVa, Va, VIa, VIIa and VIIIa, or an oxide of said metal.

5. An electron-emitting device according to claim 1, wherein said material having the higher melting point is a metal made up of an element selected from Mo, Hf, W and Ni, or an oxide of said metal.

6. An electron-emitting device according to claim 1, wherein said film made primarily of a material having the higher melting point is formed of fine particles having an average particle size not less than 30 nm.

7. An electron-emitting device according to claim 1, wherein said electron emitting region is a fissure formed in said electroconductive film.

8. An electron-emitting device comprising:

a pair of electrodes;

an electroconductive film arranged between said electrodes, said electroconductive film having an electron emitting region including a fissure; and a coating film arranged in said fissure and connected to said electroconductive film to form within said fissure a gap narrower than said fissure, said coating film being made primarily of a material which develops a vapor pressure of $1.3\times10^{-3}$ Pa, at a higher temperature than the material of said electroconductive film, wherein said material is a metal or a metal oxide.

9. An electron-emitting device according to claim 8, wherein said coating film is also arranged on and end, facing said fissure, of said electroconductive film positioned on the high potential side.

10. An electron-emitting device according to claim 9, wherein said coating film is also arranged on another end, facing said fissure, of said electroconductive film positioned on the low potential side.

11. An electron-emitting device according to claim 8, wherein said material is a metal made up of an element selected from a group of elements belonging to groups IVa, Va, VIa, VIIa and VIIIa, or an oxide of said metal.

12. An electron-emitting device according to claim 8, wherein said material is a metal made up of an element selected from Mo, Hf, W and Ni, or an oxide of said metal.

13. An electron-emitting device according to claim 8, wherein said film is formed of fine particles having an average particle size not less than 30 nm.

14. An electron-emitting device according to claim 8, wherein said electron emitting region is a fissure formed in said electroconductive film.

15. An electron-emitting device according to any of claims 1–3, 4–10 and 11–14, wherein said electron-emitting device is a surface conduction electron-emitting device.

16. An electron source comprising a plurality of electron-emitting devices arrayed on a base plate, wherein said electron-emitting devices are each the electron-emitting device according to any of claims 1–3, 4–10 and 11–14.

17. An electron source according to claim 16, wherein said electron-emitting devices are each a surface conduction electron-emitting device.

18. An electron source according to claim 16, wherein a device row comprising a plurality of electron-emitting devices electrically interconnected is arranged in plural number.

19. An electron source according to claim 16, wherein said plurality of electron-emitting devices are electrically interconnected in matrix wiring.

20. An image-forming apparatus comprising an electron source which comprises a plurality of electron-emitting devices arrayed on a base plate, and an image-forming member, wherein said electron source is the electron source according to claim 16.

21. An image-forming apparatus according to claim 20, wherein said electron-emitting devices are each a surface conduction electron-emitting device.

22. An image-forming apparatus according to claim 20, wherein said electron source is an electron source in which a device row comprising a plurality of electron-emitting devices electrically interconnected is arranged in plural number.

23. An image-forming apparatus according to claim 20, wherein said electron source is an electron source in which said plurality of electron-emitting devices are electrically interconnected in matrix wiring.

24. An image-forming apparatus according to claim 20, wherein said image-forming member is a fluorescent substance.

25. An electron-emitting device according to claim 1 or 8, wherein said coating film is disposed also on said electroconductive film.

26. An electron-emitting device comprising:

a pair of electroconductive films disposed opposite to each other with a first space;

a film disposed within said first space and connected to at least one of said pair of electroconductive films so that a second space narrower that said first space is formed within said first space, said film including as primary component a material having a melting point higher than the melting point of said electroconductive film; and a pair of electrodes connected to respective films of said pair of electroconductive films, wherein said material having said higher melting point is metal or metal oxide.

27. An electron-emitting device comprising:

a pair of electroconductive films disposed opposite to each other with a first space;

a film disposed within said first space and on one of said electroconductive films and connected to at least one of said pair of electroconductive films so that a second space narrower than said first space is formed within said first space, said film including as primary component a material having a melting point higher than the melting point of said electroconductive film; and a pair of electrodes connected to respective films of said pair of electroconductive films, wherein said material having said higher melting point is metal or metal oxide.

28. An electron-emitting device comprising:

a pair of electroconductive films disposed opposite to each other with a first space;

a film disposed within said first space and connected to each of said pair of electroconductive films so that a second space narrower than said first space is formed within said first space, said film including as primary component a material having a melting point higher than the melting point of said electroconductive film; and a pair of electrodes connected to respective films of said pair of electroconductive films, wherein said material having said higher melting point is metal or metal oxide.

29. An electron-emitting device comprising:

a pair of electroconductive films disposed opposite to each other with a first space;

a film disposed within said first space and on said pair of electroconductive films and connected to each of said pair of electroconductive films so that a second space narrower than said first space is formed within said first space, said film including as primary component a material having a melting point higher than the melting point of said electroconductive film; and a pair of electrodes connected to respective films of said pair of electroconductive films, wherein said material having said higher melting point is metal or metal oxide.

30. An electron-emitting device comprising:

a pair of electroconductive films disposed opposite to each other with a first space;

a film disposed within said first space and connects to at least one of said pair of electroconductive films so that a second space narrower than said first space if formed within said first space, said film including as primary component a first material providing a vapor pressure of $1.3\times10^{-3}$ Pa at higher temperature than a second material of said electroconductive films; and a pair of electrodes connected to respective films of said pair of electroconductive films, wherein said first material is metal or metal oxide.

31. An electron-emitting device comprising:

a pair of electroconductive films disposed opposite to each other with a first space;

a film disposed within said first space and on one said electroconductive films and connected to at least one of said pair of electroconductive films and connected to at least one of said pair of electroconductive films so that a second space narrower than said first space is formed within said first space, said-film including as primary component a second material providing a vapor pressure of $1.3\times10^{-3}$ Pa at higher temperature than a first material of said electroconductive films; and a pair of electrodes connected to respective films of said pair of electroconductive films, wherein said first material is metal or metal oxide.

32. An electron-emitting device comprising:

a pair of electroconductive films disposed opposite to each other with a first space;

a film disposed within said first space and connected to each of said pair of electroconductive films so that a second space narrower than said first space is formed within said first space, said film including as primary component a first material providing a vapor pressure of $1.3\times10^{-3}$ Pa at higher temperature than a second material of said electroconductive films; and a pair of electrodes connected to respective films of said pair of electroconductive films, wherein said first material is metal or metal oxide.

33. An electron-emitting device comprising:

a pair of electroconductive films disposed opposite to each other with a first space;

a film disposed within said first space and on said pair of electroconductive films and connected to each of said pair of electroconductive films so that a second space narrower than said first space is formed within said first space, said film including as primary component a first material providing a vapor pressure of $1.3\times10^{-3}$ Pa at higher temperature than a second material of said electroconductive films; and a pair of electrodes connected to respective films of said pair of electroconductive films, wherein said first material is metal or metal oxide.

34. An electron-emitting device according to any one of claims 26–33, wherein said electron-emitting device is a surface conduction electron-emitting device.

35. An electron source comprising a plurality of electron-emitting devices arrayed on a base plate, wherein said electron-emitting devices are each the electron-emitting device according to any one of claims 26–33.

* * * * *

UNITED STATES PATENT AND TRADEMARK OFFICE

CERTIFICATE OF CORRECTION

PATENT NO. : 6,147,449
DATED : November 14, 2000
INVENTOR(S) : Tatsuya Iwasaki et al.

It is certified that error appears in the above-identified patent and that said Letters Patent is hereby corrected as shown below:

Column 2,
Line 37, "by" should be deleted.

Column 5,
Line 30, "will-be" should read -- will be --.

Column 7,
Lines 53 and 64, "Forming" should read -- forming --.

Column 13,
Line 64, "an" should read -- a --.

Column 14,
Line 40, "FETS" should read -- FETs --.

Column 19,
Line 24, "psec." should read --$\mu$sec. --;
Line 34, "scannig" should read -- scanning --.

Column 26,
Line 22, "$10^2$ should read -- 102 --.

Column 30,
Line 43, "mental" should read -- metal --.

Column 31,
Line 14, "and" should read -- an --;
Line 61, "row" should read -- now --.

UNITED STATES PATENT AND TRADEMARK OFFICE

CERTIFICATE OF CORRECTION

PATENT NO. : 6,147,449
DATED : November 14, 2000
INVENTOR(S) : Tatsuya Iwasaki et al.

It is certified that error appears in the above-identified patent and that said Letters Patent is hereby corrected as shown below:

Column 33,
Line 23, "said-film" should read -- said film --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*